US009849055B2

(12) United States Patent
Vertsteylen et al.

(10) Patent No.: US 9,849,055 B2
(45) Date of Patent: Dec. 26, 2017

(54) MULTI-LAYERED HAZARDOUS MATERIAL CONTAINMENT BAG

(71) Applicant: Paper-Pak Industries, Laverne, CA (US)

(72) Inventors: Sayandro Vertsteylen, Fontana, CA (US); Richard Beu, Yorba Linda, CA (US); Ronald Jensen, Chicago, IL (US)

(73) Assignee: NOVIPAX INC., La Verne, CA (US)

( * ) Notice: Subject to any disclaimer, the term of this patent is extended or adjusted under 35 U.S.C. 154(b) by 12 days.

(21) Appl. No.: 14/979,141

(22) Filed: Dec. 22, 2015

(65) Prior Publication Data

US 2016/0176622 A1 Jun. 23, 2016

Related U.S. Application Data

(60) Provisional application No. 62/095,159, filed on Dec. 22, 2014.

(51) Int. Cl.
*A61G 17/04* (2006.01)
*A61G 17/06* (2006.01)

(52) U.S. Cl.
CPC ..... *A61G 17/047* (2016.11); *A61G 17/06* (2013.01)

(58) Field of Classification Search
CPC .... A61G 17/06; A61G 7/1055; A61G 17/007; A61G 17/047; B65D 85/70; B65D 85/94; B65D 31/02; B65D 85/82; B65D 37/00; B65D 33/08; B65D 33/2591; B65D 75/225
USPC ..... 27/11, 28; 383/100, 103, 66, 24, 113, 383/106, 61.2, 63; 493/186, 212–214, 493/217, 226
See application file for complete search history.

(56) References Cited

U.S. PATENT DOCUMENTS 3,999,653 A 12/1976 Haigh et al.
2,709,293 A 5/1988 Schwaderer et al.
4,790,051 A * 12/1988 Knight ..... A61G 1/01 27/28
4,969,750 A 11/1990 Russo et al.
(Continued)

OTHER PUBLICATIONS

International Search Report dated Mar. 4, 2016 for PCT application No. PCT/US15167499.
(Continued)

*Primary Examiner* — William Miller
(74) *Attorney, Agent, or Firm* — Dorsey & Whitney LLP

(57) ABSTRACT

A hazardous material containment bag and bag system for handling and transporting contaminated material or human remains is provided. The bag has a multi-layered structure that minimizes contamination by a chemical, biological, radiological and/or toxicological agent. The bag has an absorbent and/or adsorbent layer, which will help keep any hazardous components dissolved in bodily fluids immobilized inside the bag. The bag also has an active agent in at least one layer individually selected to neutralize or trap more than one type of contaminant. A bag system is also provided having an inner bag and a separate outer bag with the inner bag being a multi-layered structure having an absorbent material, which will help immobilize hazardous liquid, bodily fluids, and/or gases emanating from a contaminant enclosed in the inner bag. A method for using the hazardous material containment bag and bag system is also provided.

8 Claims, 24 Drawing Sheets

(56) References Cited

U.S. PATENT DOCUMENTS

| | | | | |
|---|---|---|---|---|
| 5,659,933 | A * | 8/1997 | McWilliams | A61G 17/007 27/28 |
| 7,337,511 | B2 | 3/2008 | Yu et al. | |
| 7,484,275 | B2 * | 2/2009 | Carroll | A61G 17/007 27/28 |
| 7,496,995 | B2 * | 3/2009 | Rosario | A01N 1/00 220/89.1 |
| 8,183,426 | B2 * | 5/2012 | Cole | A61L 2/238 502/439 |
| 8,777,001 | B1 | 7/2014 | Bennett | |
| 8,966,727 | B1 * | 3/2015 | Green | A61G 17/06 27/28 |
| 8,991,019 | B1 * | 3/2015 | Calvert | A01N 1/00 27/28 |
| 9,161,860 | B2 * | 10/2015 | Jensen | A61F 13/15 |
| 9,216,128 | B2 * | 12/2015 | Richardson | A61G 17/06 |
| 2005/0138783 | A1 * | 6/2005 | Craig | A61G 17/06 27/28 |
| 2010/0263178 | A1 | 10/2010 | Jensen et al. | |
| 2013/0174392 | A1 * | 7/2013 | Chua | A61G 17/06 27/28 |

OTHER PUBLICATIONS

Written Opinion dated Mar. 4, 2016 for PCT application No. PCT/US15/67499.

* cited by examiner

MULTI-LAYERED HAZARDOUS MATERIAL CONTAINMENT BAG

CROSS-REFERENCE TO RELATED APPLICATIONS

The present application claims priority to U.S. Provisional Patent Application No. 62/095,159, filed on Dec. 22, 2014, which is herein incorporated by reference.

BACKGROUND OF THE DISCLOSURE

1. Field of Disclosure

The present disclosure relates to a hazardous material containment bag system. More particularly, the present disclosure relates to a hazardous material containment bag system having a multi-layered structure or bags that form a matrix of structural layers and active agent(s) to minimize contamination when handling or transporting human remains or hazardous materials exposed to a chemical, biological, radiological, and/or toxicological agent.

2. Description of the Related Art

Safe containment for the handling and transporting of hazardous materials, such as contaminated forensic material and equipment and, particularly, human remains continues to be a problem. Those handling such contaminated material run the risk of being exposed to the contamination and, as a result, of themselves being contaminated.

Conventional bags for the handling and transporting of contaminated material or of human remains generally comprise a tough, impermeable, preferably air- and fluid-tight, outer material. If the outer material is torn, punctured or otherwise compromised, the containment ability of conventional bags for the handling and transporting of contaminated material is lost in whole or in part.

Conventional bags for the handling and transporting of contaminated material or human remains provide only non-specific protection against contamination by a chemical, biological, radiological, and/or toxicological agent. By "non-specific" is meant protection that is not designed or directed to containing the specific contamination that is present. As a result, those handling and/or transporting such contaminated material or human remains run the risk of exposure and usually wear auxiliary protection. Such auxiliary protection has shortcomings, such as being cumbersome, preventing effective communication between those handling and/or transporting the contaminated material or human remains, and being not completely effective unless appropriately selected for the particular contamination faced. In this latter regard, often the precise nature of the contamination is not immediately known, so that the selection of the containment for the contaminated material or human remains, and/or the protection for those handling and transporting contaminated materials or human remains, involves a level of guesswork.

Therefore, a need exists for a bag or bag system for the handling and transporting of contaminated material, such as chemicals, biological materials, radiological materials, and/or toxicological agents, or human remains that can provide secure containment of the contaminating agent that is the source of such contaminated material or human remains.

A need also exists for a bag or bag system for the handling and transporting of contaminated material or human remains that can provide safe and effective protection for those handling and transporting such contaminated material or human remains.

A need further exists for a bag or bag system for the handling and transporting of contaminated material or human remains for which the identity of the contaminating agent is not known.

In addition, a need exists for a bag or bag system for the handling and transporting of contaminated material or human remains that serves to maintain to a large degree its containment ability if the bag is torn, punctured or otherwise compromised.

SUMMARY OF THE DISCLOSURE

The present disclosure provides a hazardous material containment bag or bag system for the handling and transporting of contaminated material, such as chemicals, biological materials, radiological materials, and/or toxicological agents, or human remains.

The present disclosure also provides such a hazardous material containment bag that has a multi-layered structure or bags that form a matrix of structural layers and active agent(s) to minimize (as defined herein, to prevent or at least reduce) contamination by a chemical, biological, radiological and/or toxicological agent.

The present disclosure further provides a hazardous material containment bag that has a multi-layered structure that forms a matrix of structural layers and active agent(s) for handling and transporting of contaminated material or human remains that is a flexible, sealable container having an outer substrate that forms the overall structure of the hazardous material containment bag, and a closure that provides access to the inside of the hazardous material containment bag and, thus, opens and closes the bag, and an absorbent body inside the hazardous material containment bag.

The present disclosure yet further provides a hazardous material containment bag that has a multi-layered structure that forms a matrix of structural layers and active agent(s), in which an active agent is present in any of its structural layers that is selected to neutralize or minimize contamination by a contaminant that is a chemical, biological, radiological and/or toxicological agent, to provide flexibility and adaptability to handle the challenge of the contaminant.

The present disclosure still further provides that a hazardous material containment bag that has a multi-layered structure that forms a matrix of structural layers and active agent(s) that can be made of a material and/or chemical agent in its structure that interacts with odor-causing chemical compounds from the human remains, embalming chemicals, or contaminated material inside the hazardous material containment bag, to prevent or at least reduce migration of the odor-causing chemical compounds into the ambient environment by the absorption or adsorption of gases or odors including volatile chemicals.

The present disclosure also provides that a multi-layer hazardous material containment bag that has a multi-layered structure that forms a matrix of structural layers and active agent(s) can optionally incorporate nanotechnology, such as nanoparticles, in any of its structural layers to increase the safety of handling, containment, and transportation of material, human remains, or hazardous materials.

The present disclosure further provides for one of the layers in the multi-layered structure being an absorbent material, which will help immobilize hazardous liquid, bodily fluids, and/or gases emanating from the hazardous contaminants or human remains.

The present disclosure further provides for a second embodiment which is a bag system having an inner bag and a separate outer bag with the inner bag being a multi-layered structure having an absorbent material, which will help immobilize hazardous liquid, bodily fluids, and/or gases emanating from the hazardous contaminants or human remains.

As mentioned above, the present disclosure relates to a hazardous material containment bag or bag system. More particularly, the present disclosure relates, in one embodiment, to a hazardous material containment bag for transporting human remains, or a deceased animal body (e.g., a horse or dog), or a hazardous material that has been contaminated by a chemical, biological, radiological, and/or toxicological agent.

BRIEF DESCRIPTION OF THE DRAWINGS

FIG. 15(*b*) is a detailed view of a portion of the inner biological containment bag of FIG. 15(*a*).

FIG. 17(*b*) is a detailed view of a portion of the inner chemical containment bag of FIG. 17(*a*).

FIG. 17(*c*) is a cross-sectional view of anther embodiment of the inner chemical containment bag of FIG. 17(*a*).

FIG. 17(*d*) is a detailed view of a portion of the inner chemical containment bag of FIG. 17(*c*).

DETAILED DESCRIPTION OF THE DISCLOSURE

Figure 1:
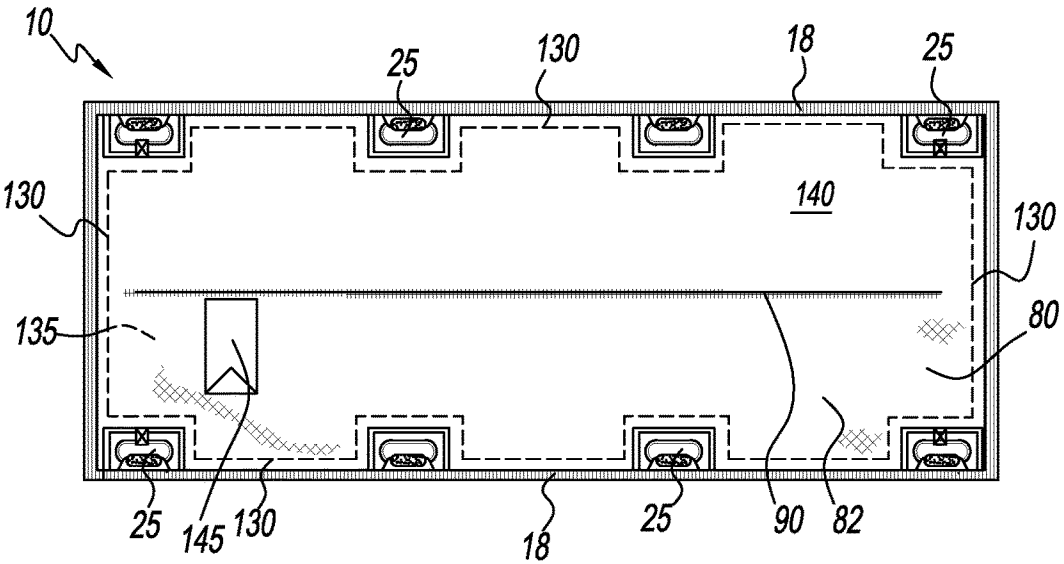
FIG. 1 shows a top plan view of an embodiment of a hazardous material containment bag of the present disclosure.

Referring now to the drawings and, in particular, to FIG. 1, there is shown a first exemplary embodiment of a hazardous material containment bag of the present disclosure generally represented by reference numeral 10. The overall aesthetic appearance of hazardous material containment bag 10 is analogous to the lightweight absorbent body bag disclosed in pending U.S. patent application Ser. No. 12/741,331, now published as U.S. Patent Application Publication No. 2010/0263178A1, which application is incorporated by reference. However, hazardous material containment bag 10 of the present disclosure has a multi-layered structure. This structure forms a matrix of structural layers and active agent(s) to minimize (as defined herein means prevent or at least reduce) contamination by a chemical, biological, radiological and/or toxicological agent.

As used in this application, "minimize" (or "minimizing") contamination means prevent (or substantially prevent) or at least reduce contamination by a chemical, biological, radiological and/or toxicological agent.

To "reduce" contamination means to decrease contamination by at least 50% as compared with a conventional bag; and more preferably, means to decrease contamination by at least 60%, 70%, 75%, 80%, 85%, 90%, 95%, or 99%, and all increments therein, and optimally 100%. Clearly, the larger percentage decrease in contamination is the most preferred.

The matrix of structural layers and active agent(s) of hazardous material containment bag 10 can be selected to provide optimal effectiveness, flexibility and adaptability to minimize contamination by a chemical, biological, radiological and/or toxicological agent.

In one embodiment, hazardous material containment bag 10 has a matrix of structural layers and an active agent that form a "base" structure that minimizes contamination by a known range of chemical, biological, radiological and/or toxicological hazards, and which can also be used even when the chemical, biological, radiological and/or toxicological hazard has not yet been identified.

In another embodiment, hazardous material containment bag 10 has a matrix of structural layers and an active agent that are selected to form a "targeted" structure that minimizes contamination by a particular range of chemical, biological, radiological and/or toxicological agents that have been identified.

For example, the structural layers of materials in hazardous material containment bag 10 can be selected as to the number of layers, the material used for each layer, the thickness of each layer, the spacing between adjacent layers, and one or more coatings or treatments (e.g., urethane coating, surfactant) on or in each layer.

Similarly, hazardous material containment bag 10 can have one or more active agents that are a chemical compound present in and/or on any layer to interact with and minimize contamination by a chemical, biological, radiological and/or toxicological agent. For example, a structural layer that forms an interior surface of cover 80 and/or backing substrate 12 can have an active agent that is a chemical compound that chemically reacts with and neutralizes a toxic and/or noxious gas exuded by human remains or a hazardous material enclosed in hazardous material containment bag 10.

In another embodiment, hazardous material containment bag 10 also has a chemical compound that is a surface active agent for odor control. Any layer can also have another active agent that is a chemical compound that interacts with an odor-causing agent exuded from human remains, embalming chemical, or hazardous material to chemically neutralize the odorous compound, or that adsorbs or absorbs the odorous compound. In this embodiment, hazardous material containment bag 10 also has one or more structural layers that form a physical barrier to penetration by an odorous compound, where the one or more structural layers are, for example, the backing substrate, absorbent body, cover, and/or the sublayers that form one or more of these structures. For example, a structural layer that is part of cover 80 and or backing substrate 12 can have a chemical compound that is a highly porous material that attracts, adsorbs and traps volatile organic compounds on its surface (such as, but not limited to, activated carbon), and thereby minimizes the amount of volatile organic compounds penetrating cover 80 and/or backing substrate 12. In this embodiment, the matrix of active agent and structural layers prevents or at least reduces the odorous compound from penetrating hazardous material containment bag 10, where the odorous compounds would otherwise contaminate the bearers and the nearby environment.

Figure 2:
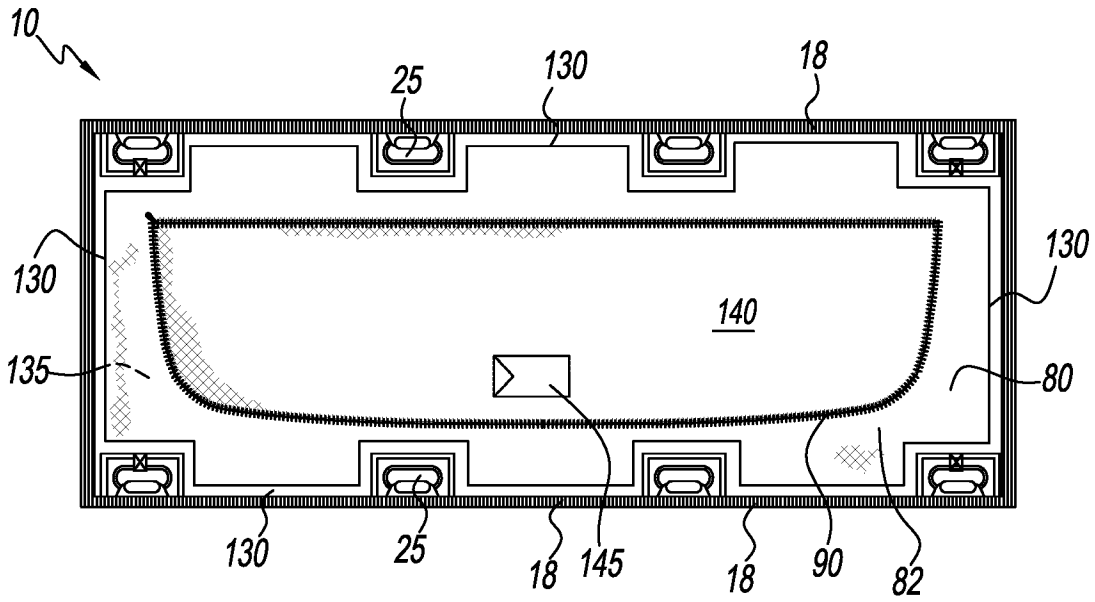
FIG. 2 shows a top plan view of another embodiment of a hazardous material containment bag of the present disclosure.

Referring to FIGS. 1 to 4, hazardous material containment bag 10 has a cover 80. Cover 80 includes a closure 90. Hazardous material containment bag 10 preferably has one or more gripping devices 25 along one side of hazardous material containment bag 10, and corresponding gripping devices 25 along the opposite side of hazardous material containment bag 10. Gripping devices 25 are provided with a reinforcement piece 35 to strengthen gripping devices 25 for use. Cover 80 includes a recloseable flap 140 that can be opened to provide access to the interior of hazardous material containment bag 10 for contaminated material or human remains to be placed therein. FIGS. 1 and 2 each illustrate a different reclosable flap 140. Further, recloseable flap 140 is in the closed position in each of FIGS. 1 and 2.

A binder 18 can be connected to one or more edges at the perimeter of hazardous material containment bag 10. Binder 18 provides a defined edge to and reinforces the integrity and shape of hazardous material containment bag 10 when in use. Binder 18 can be made of a webbing material, such as polyester or polypropylene, or nylon or a nylon-based material. Binder 18 can be connected to hazardous material containment bag 10 with thread, adhesive, VELCRO®, or can be thermally attached. Binder 18 can be attached onto the edge of hazardous material containment bag 10 to a width of between about one-quarter (¼) inch and about 2 inches, with a preferred width of about 1.25 inches along a long edge of hazardous material containment bag 10. Hazardous material containment bag 10 also has a thermal seal 130 around the perimeter of the hazardous material containment bag 10, thereby forming a compartment 135 having a continuous seal to make compartment 135 partially or, preferably, completely water- and fluid-resistant or impervious. Hazardous material containment bag 10 can also have one or more pockets 145 for storing documents.

Hazardous material containment bag 10 can also have one or more gussets (not shown), or gusset areas, that provide extra material for expansion of containment bag 10 to address if the contaminated item or decedent's body are large. Each gusset is preferably located at a corner of containment bag 10. More preferably, containment bag 10 has a gusset at each of the four corners. In another embodiment, each gusset can have from about one (1) inch or larger seal at the seal point, and more preferably has a six (6) inch seal at the seal point, in all four corners of containment bag 10.

Figure 3:
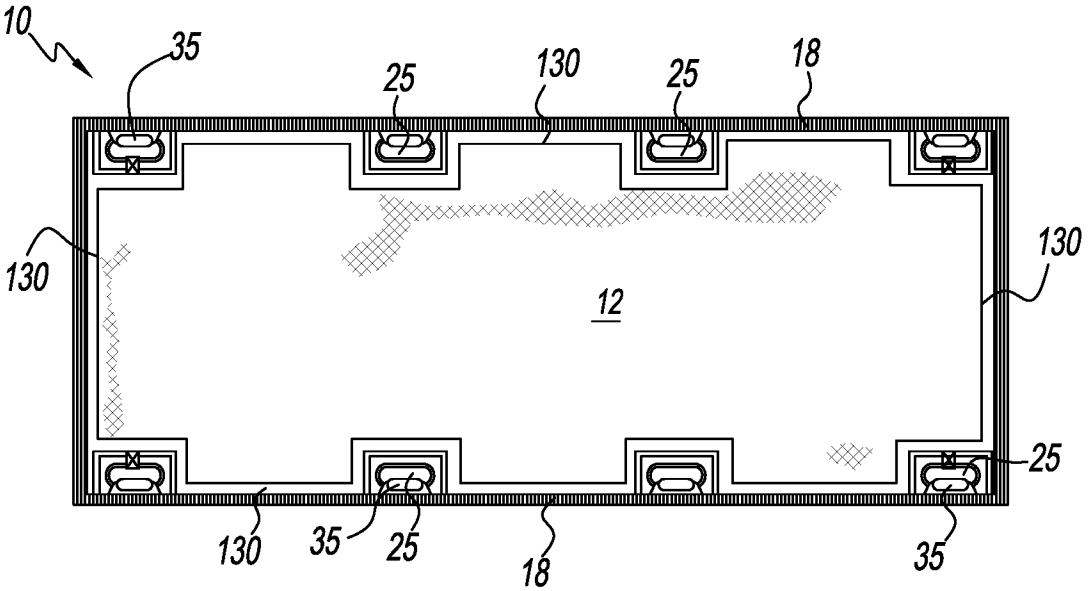
FIG. 3 shows a bottom view of the hazardous material containment bag of the embodiments of FIG. 1 or 2.

Cover 80 has a first side (not shown) and a second side 82. First side faces the bottom side of hazardous material containment bag 10, and second side 82 is a top (outside or exposed) side of cover 80. The second (top) side 82 of cover 80 is shown in FIGS. 1 and 2. Cover 80 is positioned on the top of hazardous material containment bag 10 and is connected to backing substrate 12, as shown in FIG. 3.

Cover 80 in conjunction with backing substrate 12 is intended to enclose contaminated material or human remains placed inside hazardous material containment bag 10, and also provide system integrity for the entire hazardous material containment bag 10. Cover 80 can be one or more pieces of material shaped and sized to join together on top of hazardous material containment bag 10 to form a tent-like interior in hazardous material containment bag 10 in which contaminated material or human remains can be placed to be completely enclosed and from which the contaminant is prevented or inhibited from escaping to the outside of the containment bag. Cover 80 is preferably made of one or more materials that exhibit weather resistance, water resistance, fatigue resistance, chemical resistance, and/or resistance to puncture or tearing. Cover 80 can be connected to backing substrate 12 at an outer edge of hazardous material containment bag 10, by an adhesive material or by forming a thermal seal 130 between cover 80 and backing substrate 12 or by sewing. In one embodiment of hazardous material containment bag 10, cover 80 and backing substrate 12 are connected under binder material 18 to provide hazardous material containment bag 10 with complete integrity and a finished appearance.

Cover 80 can be chosen preferably based on the hazardous material containment bag 10. Backing substrate 12 is always impervious, however again dependent on the purpose of the hazardous material containment bag 10, cover 80 can use a number of different materials. Thus, cover 80 can be a material including, but not limited to, nylon, polymer (such as polypropylene or polyethylene), plastic, polyester, polyester blend, cloth (such as canvas, hemp, flax, or cotton fiber), or combinations of these materials. In one embodiment, cover 80 is made of nylon, including treated nylon. In yet another embodiment, cover 80 is made of polyethylene or polypropylene. In an alternative embodiment, cover 80 is made of cotton or canvas, including treated canvas.

Thermal bonding can be used to form a continuous thermal seal 130 around the periphery of hazardous material containment bag 10, to form compartment 135 in hazardous material containment bag 10 that is self-contained and water-resistant/fluid-resistant. A preferred technique for thermal bonding is Radio Frequency (RF) welding technology. Alternatively, ultrasonic bonding or heat bonding techniques can create thermal seal 130. Thermal bonding can be achieved by melting a thermal bonding agent that is applied to backing substrate 12 and cover 80, creating a seam for a thermal bond that is between about one-quarter (¼) inch to about one (1) inch, and preferably about one-half (½) inch to about three-quarter (¾) inch, in a continuous segment around hazardous material containment bag 10 to form compartment 135. In an alternative embodiment, the thermal bonding uses a coating that is applied to a portion of backing substrate 12 and to cover 80 to create the thermal seal 130 including, but not limited to, a urethane coating.

Referring to FIG. 3, hazardous material containment bag 10 has a backing substrate 12 that forms a part of, or the entire, back surface of the hazardous material containment bag. Backing substrate 12 has a first side and a second side. The first side faces the top side of hazardous material containment bag 10, and the second side is a bottom (outside or exposed) side of the backing substrate 12. Backing substrate 12 provides support, ruggedness and strength to hazardous material containment bag 10.

Figure 4:
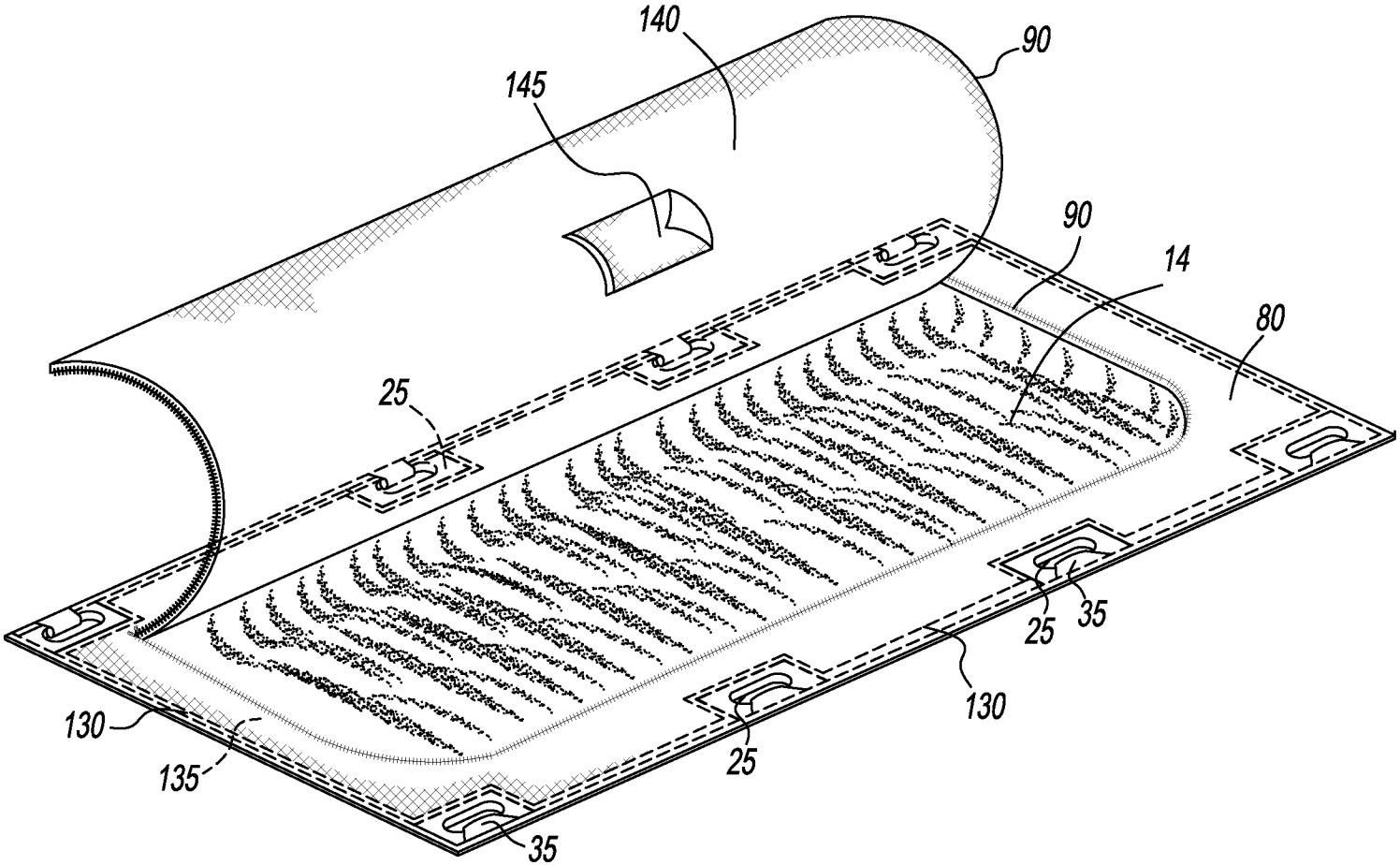
FIG. 4 shows a perspective top view of the hazardous material containment bag in FIG. 2 with a recloseable flap open.

Referring to FIG. 4, hazardous material containment bag 10 is shown with cover 80 having recloseable flap 140 in an open position, exposing first side of cover 80 and absorbent body 14 in an interior of hazardous material containment bag 10.

As shown in FIG. 1, closure 90 can run in a straight course from the top end to the bottom end of containment bag 10. More specifically, closure 90 can be a zipper that runs in a straight course, is about 103 inches in length, and stops about 2.5 inches from each of the top end and the bottom end of containment bag 10. A straight run of closure 90 preserves the teeth track of the zipper, and also avoids any leakage of the contents of containment bag 10. Alternatively, as shown in FIGS. 2 to 4, closure 90 can have an envelope-style ("D-shape") configuration in an unfastened condition, where one part of closure 90 is along the edge of recloseable flap 140 and the other part of closure 90 remains on cover 80.

Hazardous material containment bag 10 can have a pocket 145 located on any outer surface. As shown in FIG. 4, pocket 145 is in dotted lines to illustrate its location on the side of recloseable flap 140 that faces the exterior of hazardous material containment bag 10. Pocket 145 can be used to hold documents or personal items relating to the contaminated material or human remains. In one embodiment, pocket 145 is positioned on the outer surface of cover 80, again so that the information placed inside pocket 145 would be accessible without exposure to the hazardous material or remains inside containment bag 10.

FIG. 4 also shows hazardous material containment bag 10 with gripping devices 25 and a reinforcement piece 35 for each gripping device 25, as well as thermal seal 130. Binder 18 can be positioned and connected along a long edge of hazardous material containment bag 10 to overlay a small portion of absorbent body 14 and backing substrate 12.

Backing substrate 12 can be partially or completely impermeable to fluids such as water, blood, body fluids, or chemicals associated with embalming or preserving a decedent's body, and serves as a fluid barrier to prevent (or at least reduce) fluids exuded by the body from contaminating the area beneath and around hazardous material containment bag 10 or the bearers who are carrying the bag. Fluid impermeability of backing substrate 12 also reduces effects of outside water (from the ground or from rain and snow) from seeping into hazardous material containment bag 10, where such water could compromise the integrity of hazardous material containment bag 10 or a decedent's body therein. Backing substrate 12 can be a material that is naturally fluid-impermeable or a material that has been chemically treated to reduce liquid permeability (e.g., treated nylon or treated cloth), or a material that is coated to reduce liquid permeability, such as by urethane or a polyester. Backing substrate 12 is also preferably made of a material that resists tears or punctures, to provide ruggedness to hazardous material containment bag 10. Backing substrate 12 can also have a low-slip or non-slip surface so that hazardous material containment bag 10 stays in position when placed on a surface.

Absorbent body 14 is preferably connected to the first (top) side of backing substrate 12. Absorbent body 14 is typically sized less than backing substrate 12 so that a portion of the backing substrate forms an edge about a portion of absorbent body 14. Absorbent body 14 can be permanently connected to backing substrate 12, or can be removably connected (as a separate piece) to backing substrate 12. In an alternative embodiment (not shown), a portion of absorbent body 14, or another, separate absorbent body 14, can also be affixed to or cover the first side of cover 80, including the side of recloseable flap 140 that faces the interior of hazardous material containment bag 10.

An embodiment of hazardous material containment bag 10 has absorbent body 14 that is removably connected to backing substrate 12, so that the absorbent body can be replaced with a new, or different absorbent body on the same backing substrate 12. This permits the user to easily replace an absorbent body 14 having structural layers and/or chemical compounds that are selected to interact with a particular type of chemical, biological, radiological or toxicological contaminant with a different absorbent body (not shown) having structural layers and/or chemical compounds that interact with or trap a different type of chemical, biological, radiological or toxicological contaminant. Removability also permits a used absorbent body 14 to be removed after use from hazardous material containment bag 10, and replaced with a new, unused absorbent body 14. Before new absorbent body 14 could be inserted, containment bag 10 would need to be decontaminated using proper procedures and recertified as clean. Absorbent body 14 can be removably connected to backing substrate 12 (and/or to cover 80) by an adhesive material, where the adhesive material includes, but is not limited to, glue, tape, two-sided tape, thread, and/or a hook-and-loop interlocking device such as VELCRO® (Velcro Industries B.V. LLC Netherlands, Curacao, Netherlands Antilles).

In another embodiment, absorbent body 14 is positioned on all, or substantially all, of the inner surfaces of hazardous material containment bag 10, including first (inner) side of cover 80 and backing substrate 12, such that the absorbent body 14 encases the contents of hazardous material containment bag 10.

As shown in FIGS. 1 to 4, hazardous material containment bag 10 includes a backing substrate 12 and an absorbent body 14 connected to a first side of backing substrate 12 and/or connected to a first side of cover 80. In some embodiments, absorbent body 14 can also cover part or all of closure 90 when recloseable flap 140 is in the closed position. Hazardous material containment bag 10 completely encloses and encases the contaminated material or human remains placed therein when recloseable flap 140 of cover 80 is closed with closure 90.

Figure 5:
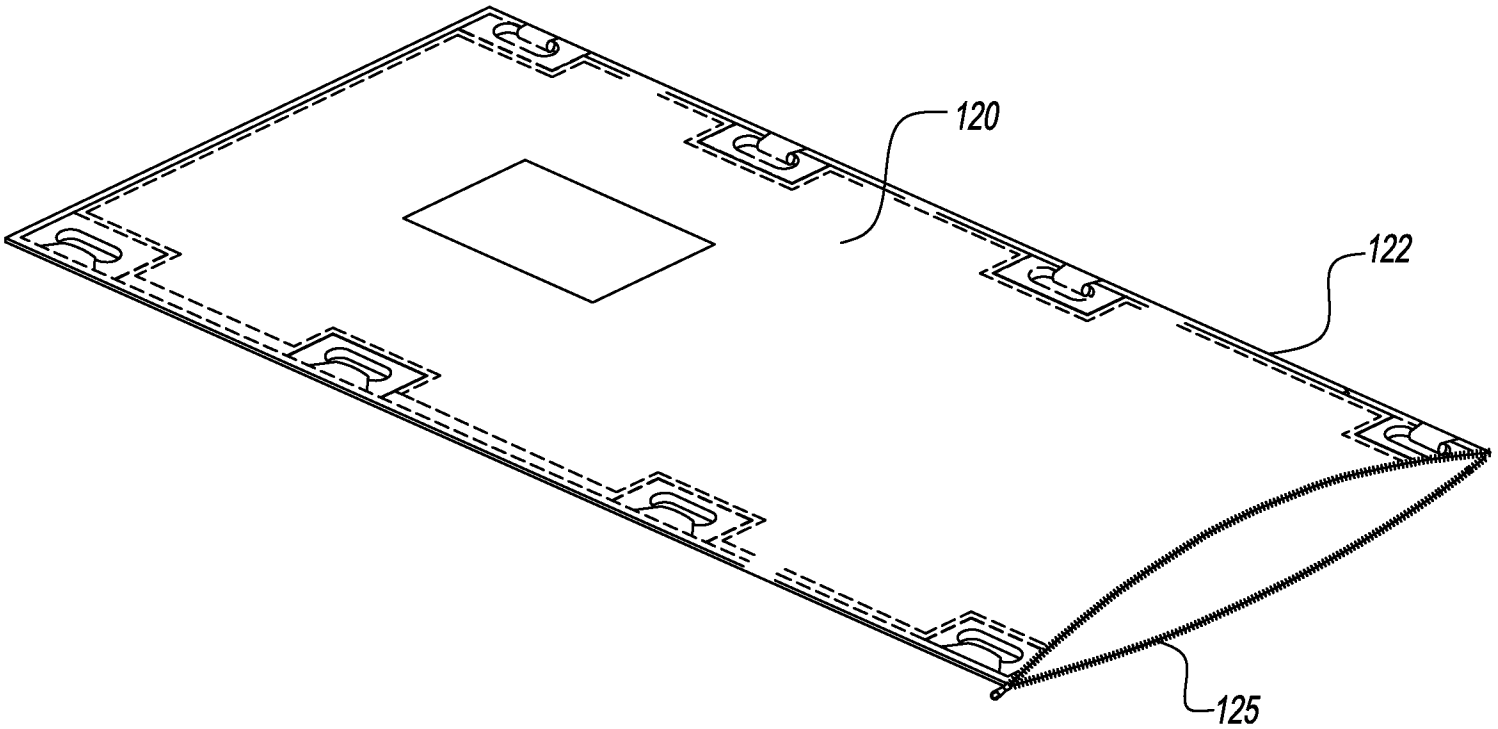
FIG. 5 is a perspective view of a portion of another embodiment of the present disclosure.
Figure 6A:
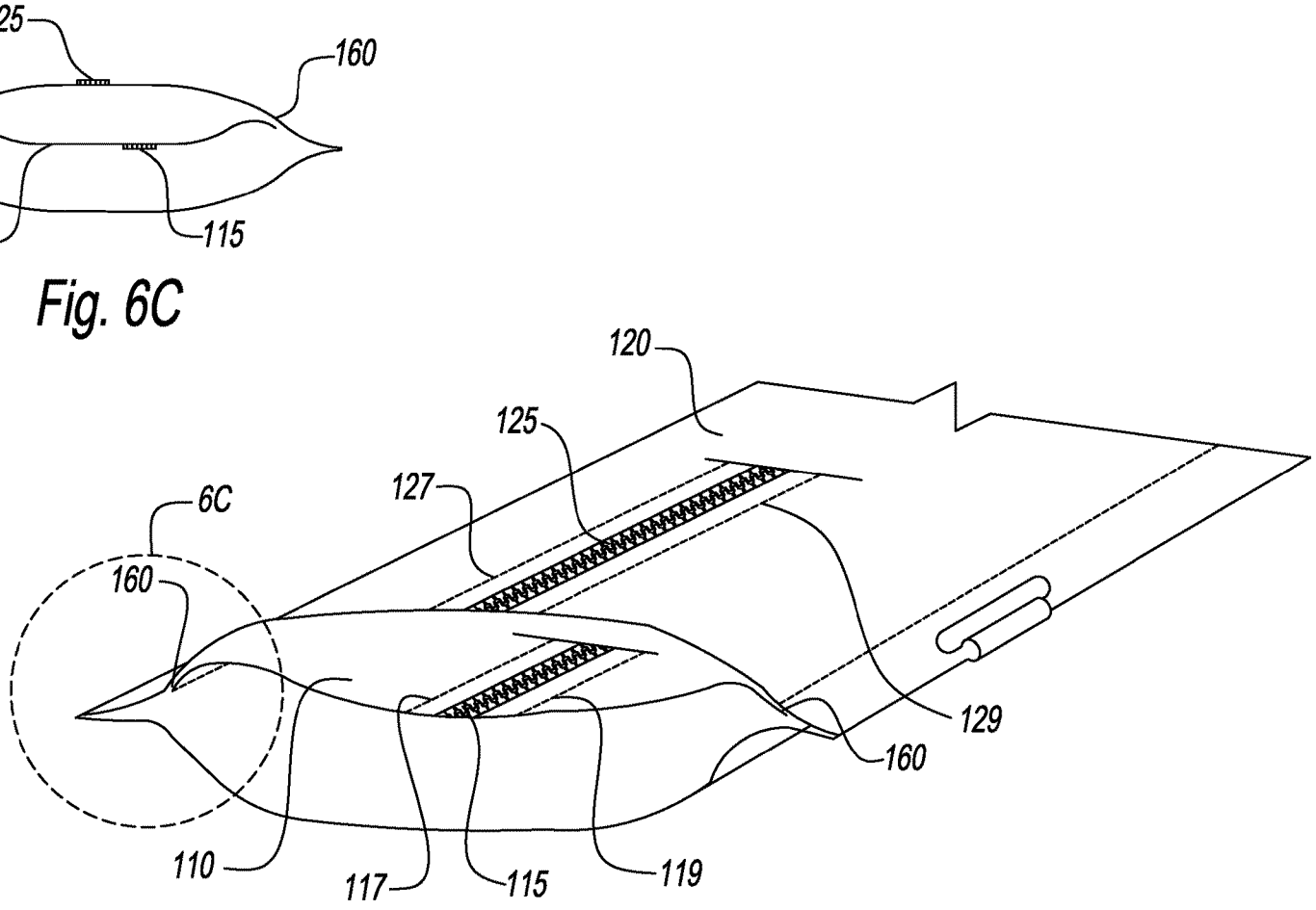
FIG. 6A shows a sectional, perspective view of the embodiment of FIG. 5.
Figure 6C:
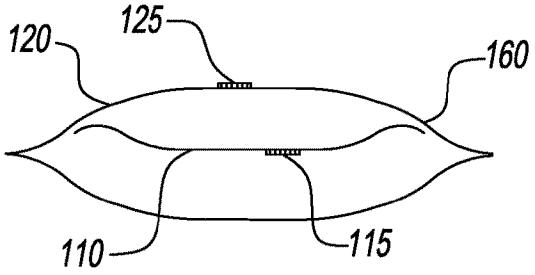
FIG. 6C is an exploded area 6C of FIG. 6A.
Figure 6B:
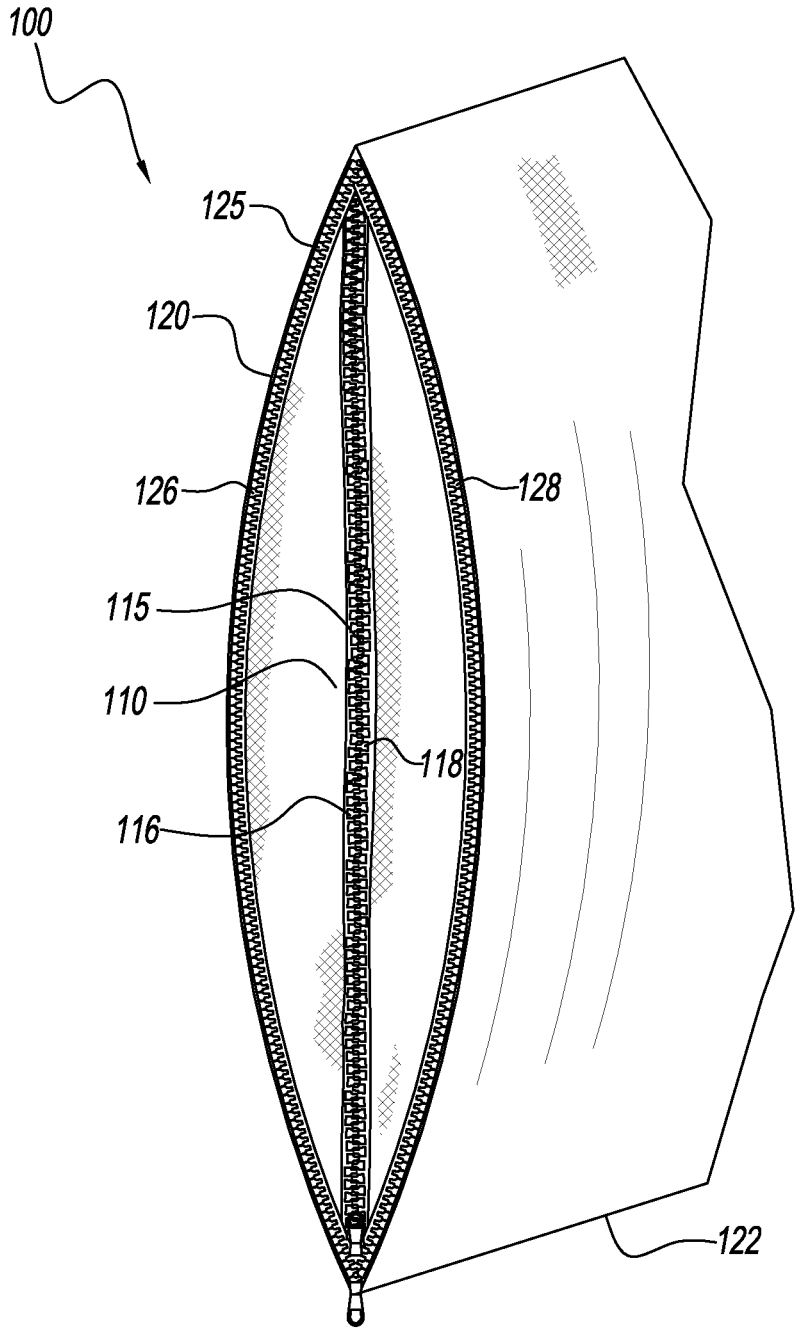
FIG. 6B shows an end perspective view of the embodiment of FIG. 5.
Figure 7:
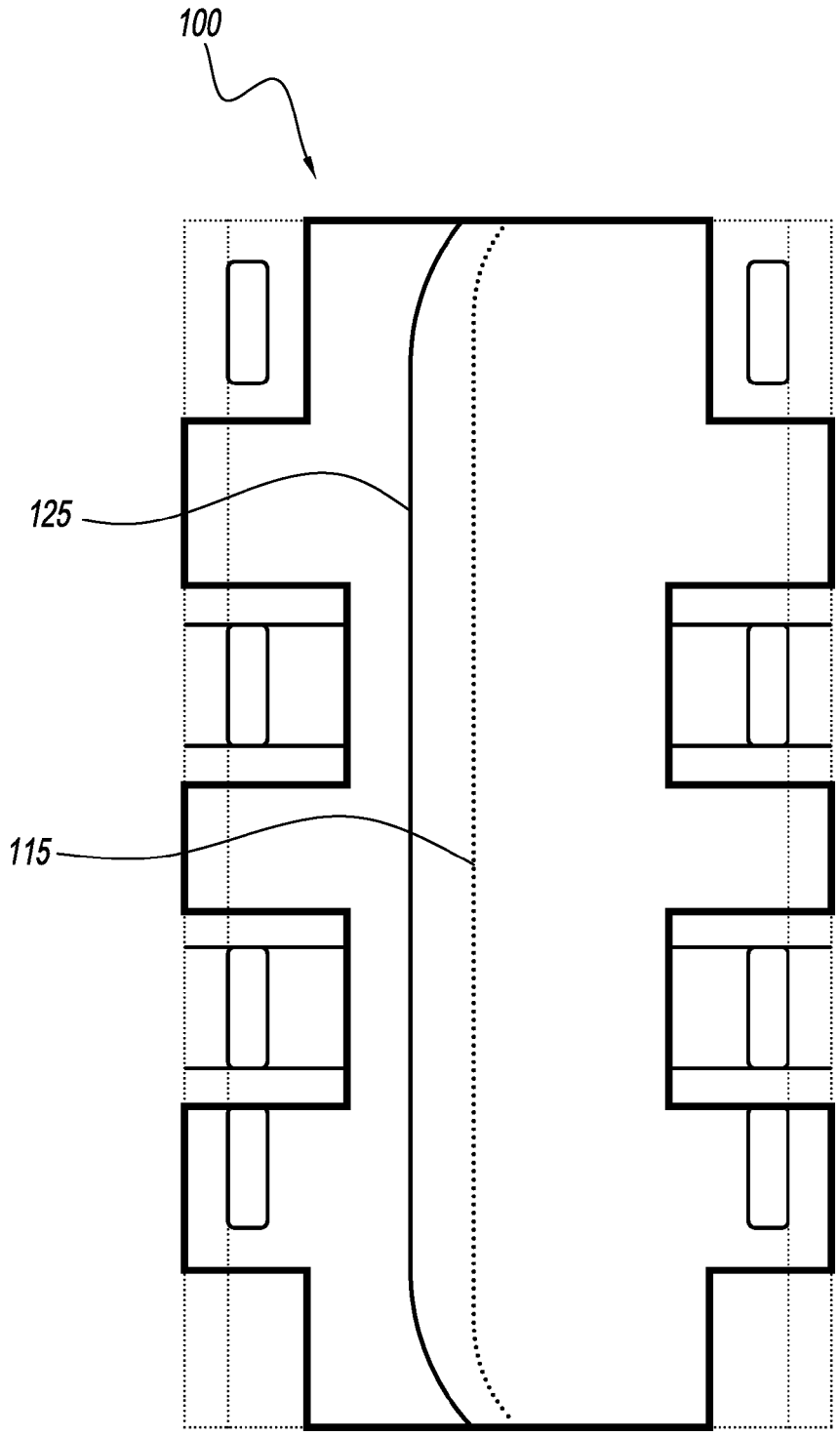
FIG. 7 shows a top, schematic of the embodiment of FIG. 5.

Referring to FIGS. 5-7, this embodiment of hazardous material containment bag 100 has two structures, namely an inner liner or shell 110 that encloses part or all of contaminated human remains or hazardous material and an outer shell 120 to enclose inner shell 110, as shown clearly in FIGS. 6A and 6B, to form a bag-inside-a-bag hazardous material containment bag 100. This hazardous material containment bag 100 isolates contaminants inside the inner liner 110 from escaping outside of hazardous material containment bag 100. The inner liner 110 can have an active agent that can absorb, adsorb, neutralize, deactivate, and/or destroy chemical, biological, radiological and/or toxicological agents. For this hazardous material containment bag 100 embodiment, outer shell 120 opens wide to allow inner shell 110, perhaps a bag, to remain physically placed therein. Inner shell 110 can be attached to outer shell 120 at welded area 160 as shown in FIG. 6C or can be unattached to outer shell 120 and simply placed therein (not shown). This hazardous material containment bag 100 embodiment offers an added benefit of one hermetical closure inside of another thereby making it harder for contaminants to escape.

Outer shell 120 of hazardous material containment bag 100 can be gas and/or vapor permeable or impervious to the passage of gas and/or vapor. Preferably, outer shell 120 is impervious to the passage of gas and/or vapor. Also preferably, all seams 122 of outer shell 120 are sealed to provide an additional degree of gas and/or vapor impervious nature to the bag for handling and transporting contaminated material or human remains. Inner shell 110 can be made of the same or different material as outer shell 120. However, it is important that the properties of outer shell 120 be directed to provide strength to hazardous material containment bag 100, and that the properties of inner shell 110 be directed to prevent or greatly reduce chemical, biological and other contaminants from escaping out of the hazardous material containment bag 100.

Outer shell 120 has a closure 125. Closure 125 provides access to the inside volume of hazardous material containment bag 100, namely inner shell 110, and should be of sufficient dimension to permit relatively simple, rapid and easy placement of the contaminated material or human remains therein. Preferably, closure 125 is a zipper having complementary male and female teeth 126, 128. Further, closure 125 is airtight and watertight. To ensure that closure 125 is watertight, closure 125 has a coating and/or is sealed with a liquid-resistant sealer, such as nickel silver elements. Closure 125 can also be tamper-evident and/or tamper-resistant. Closure 125 can be a size 10 zipper marketed under the trade name "YKK Proseal", which meets the full requirements of SOLAS Chapter 3.32.3, 46 CFR 106.171-17, NFPA 1991, 1992, 1994 Class 2, ASTM F1052 and ASTM1359. YKK Proseal is rated at approximately 0.2-0.5 bar water pressure. Closure 125 can include a wide tape having a first tape section 127 attached to teeth 126 and a second tape section 129 attached to teeth 128. The first and second tape sections 127, 129 are each made of a polyester woven fiber having polyurethane laminated to the polyester fiber. Closure 125 can slightly arc across hazardous material containment bag 100.

Inner shell 110 has a closure 115. Preferably, closure 115 is also a zipper having complementary male and female teeth 116, 118. Also, as with closure 125, closure 115 is airtight. However, closure 115 is also waterproof. To ensure that closure 115 is waterproof, closure 115 can have a coating and/or be sealed with a waterproof sealer. Closure 115 extends in a straight line across hazardous material containment bag 100 to preserve the teeth 116, 118 of closure 115 and avoid any leakage of the contents of hazardous material containment bag 100. Closure 115 can also be tamper-evident and/or tamper-resistant.

In this hazardous material containment bag 100 embodiment, closure 125 is laterally offset from closure 115 to ensure that closures 125 and 115 do not obstruct one another. Closure 125 is also longer than closure 115, preferably by about two to four inches, so that closure 115 and inner shell 110 are readily accessible when closure 125 is opened. Closure 115 can be a size 10 zipper marketed under the trade name "YKK Aquaseal", which meets the full requirements of ISO 12402-7, NFPS 1992, 1994 Class 2, ASTM F1359. YKK Aquaseal is rated at approximately 0.3 bar water pressure. Closure 115 can include a wide tape having a first tape section 117 attached to teeth 116 and a second tape section 119 attached to teeth 118. The first and second tape sections 117, 119 have a base that can be made of polyester woven fiber impregnated with polyurethane.

Referring to all embodiments, absorbent body 14 is made of an absorbent or superabsorbent material, and can absorb a large quantity of liquid, such as blood or other body fluids, or embalming chemicals, that are exuded from a decedent's body or by contaminated material in hazardous material containment bag 10. Examples of absorbent and superabsorbent materials that can be used for absorbent body 14 include, but are not limited to, cellulose, cellulose fiber, airlaid, airlaid nonwoven, airlaid composite, fluff pulp, bonding fiber, superabsorbent polymer (SAP), SAP composite, compressed composite containing a portion of short or microfiber material, thermoplastic polymer fiber, thermoplastic polymer granule, cellulose powder, cellulose gel, airlaid with SAP, fibrous or foam structure coated or impregnated with SAP, starch-based absorbents or starch-based superabsorbents, such as BioSAP™ (Archer Daniels Midland, Decatur, Ill.), and any combinations thereof. In one embodiment, absorbent body 14 is made of one or more layers of tissue. In another embodiment, absorbent body 14 has a top layer that is a low-slip or non-slip material, or treated with a non-slip agent, to reduce movement or slipping of a decedent's body. In another embodiment, absorbent body 14 has a top surface or top layer that is made of polyethylene and/or polypropylene, or that is made of nonwoven material.

Absorbent body 14 can include one or more layers of absorbent or superabsorbent material. The one or more layers of absorbent material can be a top layer, a bottom layer, and/or a middle layer. Each layer of absorbent body 14 can be positioned adjacent to another layer without being adhered to the next layer, or some (or all) of layers in the absorbent body can be bonded together into a composite structure. The one or more layers of absorbent body 14 can be bonded with an adhesive material, or by using static attraction and/or corona discharge techniques.

Any layer of absorbent material in absorbent body 14 can be treated or coated with a surfactant to regulate uptake and strikethough of liquids, or to direct absorption to another portion or zone of absorbent body 14. Examples of surfactants that can be used in the present disclosure include anionic, cationic, zwitterionic, and non-ionic surfactants.

For ease of disposability, absorbent body 14 is made in one embodiment of a biodegradable and/or compostable absorbent material, such as the starch-based absorbent or starch-based superabsorbent material noted above, including, but not limited to, BioSAP™ (Archer-Daniels Midland, Decatur, Ill.).

Absorbent body 14 is typically sized somewhat smaller than the overall outer dimensions (also called "footprint") of hazardous material containment bag 10 and backing substrate 12. Some exemplary sizes of absorbent body 14 in relation to the overall outer dimensions of hazardous material containment bag 10 are as follows:

| | Hazardous Material Containment Bag outer dimensions (width × length) | Absorbent body outer dimensions (width × length) |
|---|---|---|
| Portion* | 20" × 25" | 18" × 23" |
| Portion/Infant | 20" × 36" | 18" × 34" |

-continued

| | Hazardous Material Containment Bag outer dimensions (width × length) | Absorbent body outer dimensions (width × length) |
|---|---|---|
| Adolescent | 30" × 55" | 28" × 53" |
| Standard | 33" × 78" | 31" × 76" |
| Extra Large (XL) | 36" × 91" | 34" × 89" |

*"Portion" is a portion of a human body or other animal body.

Absorbent body 14 also can be shaped to fit easily inside hazardous material containment bag 10. In one embodiment, absorbent body has one or more cut-outs along the lengthwise sides of hazardous material containment bag 10 to prevent the absorbent body from overlapping and covering gripping devices 25.

Absorbent body 14 can have one or more strengthening layers (not shown) to improve the strength and/or resistance to tearing of the absorbent body. The one or more strengthening layers can be located on top of, below, or in between any portion of absorbent body 14. A strengthening layer can be made of standard non-woven material, or meltblown or spunlace composites. In one embodiment, the strengthening layer is a polypropylene non-woven or polypropylene/meltblown non-woven material.

As noted above, absorbent body 14 can absorb a large quantity of fluids. In one embodiment, absorbent body 14, with the use of high SAP levels, can absorb up to 7 liters of fluids, such as water or blood and other bodily fluids. In another embodiment, absorbent body 14 and a second absorbent body having the same structure of absorbent body 14 and located on the inside surface of the top of hazardous material containment bag 10 can absorb up to 6.7 liters, which is about 6,500 grams to about 6,850 grams of water, blood, or other fluids. Total absorbency of fluids is a function, in part, of the overall size and type of absorbent material employed in absorbent body 14. A typical absorbent material used in absorbent body 14 has about one-and-three-quarters (1.75) grams of absorbency per square inch of absorbent material. However, absorbency can be adjusted to a higher or lower level by changing to another, higher-performance absorbent, such as a superabsorbent.

Figure 8:
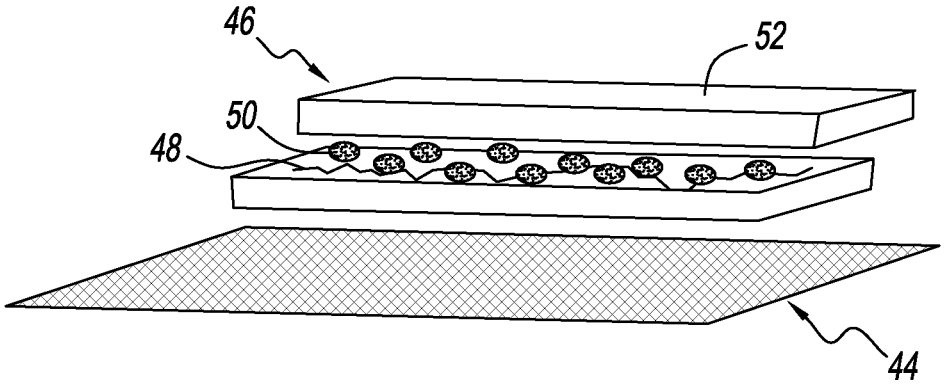
FIG. 8 is an exploded schematic view that illustrates an active agent positioned between layers of material in an embodiment of the hazardous material containment bag.

FIG. 8 illustrates an embodiment of the present disclosure in which an active agent 50 is disposed or dispersed between two absorbent layers 46, 48 that form a portion of the absorbent body. In this embodiment, cover stock 52 covers the top surface of absorbent layer 46. A backing substrate 44 is below absorbent layer 48. Other embodiments can have one or more active agents disposed in or on more than two layers of absorbent body 14.

Figure 9:
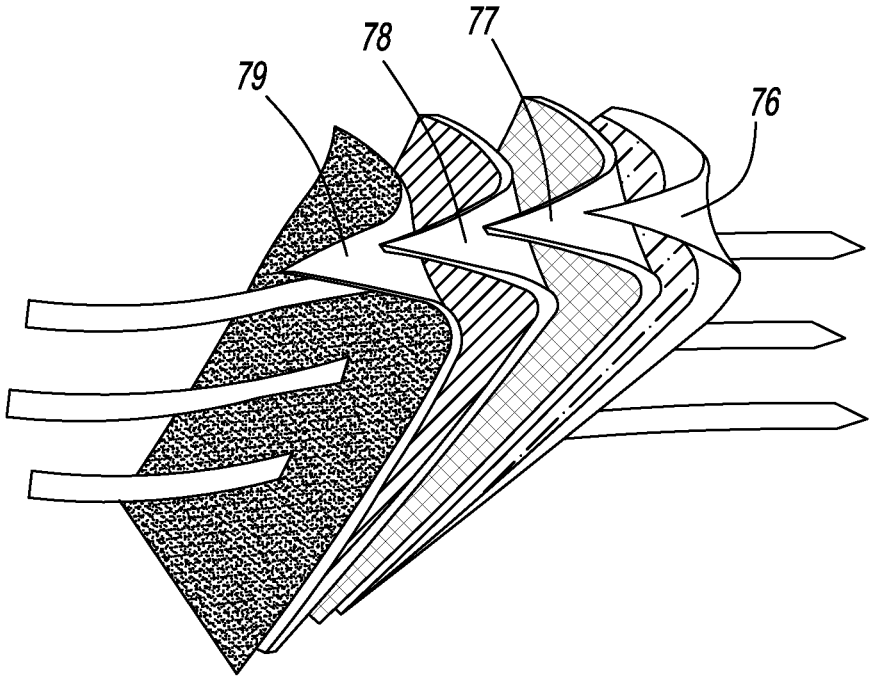
FIG. 9 shows a partially exploded view of an embodiment of a hazardous material containment bag of the present disclosure having a plurality of individual layers.

FIG. 9 illustrates an embodiment of a layer-by-layer structure of the multi-layered structure of hazardous material containment bag 10 having four structural layers. Moving from right-to-left in the direction from the exterior toward the interior of hazardous material containment bag 10, outer layer 76 forms the outer surface of backing substrate 12, and thus also forms a part of or the entire back surface of hazardous material containment bag 10. Moving inward, the next layer is an absorbent layer 77 that forms a portion of absorbent body 14, and which is adjacent to outer layer 76. Continuing inward, the next layer is another absorbent layer 78 that also forms a portion of absorbent body 14. Alternatively, layer 78 can be a protective layer. Further inward is an inner layer 79 that is adjacent to absorbent layer 78 and thus adjacent to absorbent body 14 which will be the nearest layer of the multi-layered structure to any human remains that are placed in hazardous material containment bag 10.

In an embodiment of the plurality of structural layers in FIG. 9, outer layer 76 is made of nylon backing material that can optionally have a urethane coating, absorbent layers 77 and 78 are made of one or more of the absorbent or superabsorbent materials provided above for absorbent body 14, and inner layer 79 is made of a nylon backing material with a urethane coating or similar coating layer.

In an embodiment of hazardous material containment bag 10, one or more of layers 76, 77, 78 and 79 is a laminate structure having two or more layers bonded to each other to form a laminate layer with increased strength, durability, thickness, uniformity, and/or barrier characteristics. Specifically, a laminate layer can have two, three, four, five, six, or seven layers, and preferably two to four layers, of the same material or of different materials that are bonded together. The number of layers can be larger in those laminates in which microlayers are used.

In one embodiment, absorbent layer 77 is a laminate of absorbent materials that is one or more plies of a cellulosic material, an adhesive or binder (such as glue), and can optionally have an active agent therein to form an absorbent laminate layer (not shown). The absorbent laminate layer can increase the absorbency and strength of absorbent layer 77 in a thin structure. The absorbent laminate layer preferably has an active agent incorporated therein. The active agent is uniformly distributed in a known concentration throughout the extent of hazardous material containment bag 10 simply by selecting a prescribed length and number of plies of the laminate. Incorporating the active agent in the absorbent laminate layer eliminates having large amounts of a dry, loose active agent that collects disproportionately in one portion of hazardous material containment bag 10, and leaves no "void" areas of the bag that lack a sufficient amount of the active agent to neutralize or trap a contaminant.

In another embodiment, outer layer 76 is a laminate having a nylon layer laminated with another nylon layer or with a polyethylene or polypropylene layer to form an outer laminate layer (not shown). The outer laminate layer increases the strength, durability, thickness, uniformity, and/or barrier characteristics of outer layer 76.

In yet another embodiment of the plurality of structural layers in FIG. 9, outer layer 76 is made of nylon backing material that can optionally have a urethane coating, absorbent layer 77 is made of one or more of the absorbent or superabsorbent materials provided above for absorbent body 14, protective layer 78 is made of a material including, but not limited to, SARANEX® (Dow Chemical Specialty Packaging & Films, Midland, Mich.), but which also can be OMNIFLEX® (Saint-Gobain Performance Plastics Corp., Wayne, N.J.), polyvinylidene chloride, fluoroelastomer, or combinations thereof, and inner layer 79 is made of a nylon backing material with a urethane coating or similar coating layer.

While not shown in the embodiment in FIG. 9, multi-layered structure can further include a fifth structural layer, a sixth structural layer, a seventh structural layer, and an eighth structural layer that can each be positioned between any of layers 76, 77, 78 and 79, and/or adjacent the exterior side of layer 76, or adjacent the interior side of layer 79. These additional structural layers can be a protective layer to add an additional barrier against contamination by chemical, biological, radiological and/or toxicological agents, without a change in the operation of hazardous material containment bag 10.

Figure 10:
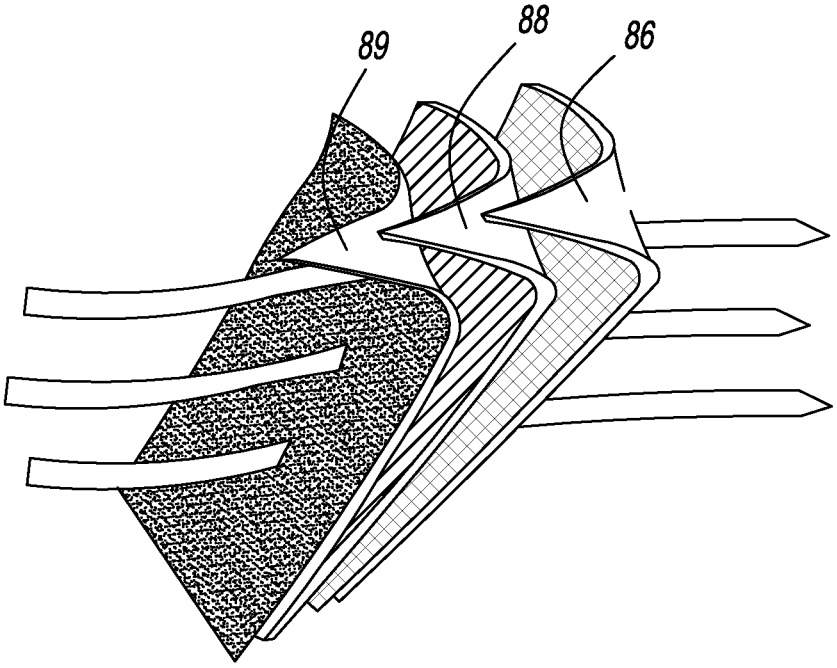
FIG. 10 shows a partially exploded view of another embodiment of a hazardous material containment bag of the present disclosure having a plurality of individual layers.

FIG. 10 shows another embodiment of hazardous material containment bag 10 that shows an embodiment of a layer-by-layer structure of multi-layer structure. In FIG. 10, hazardous material containment bag 10 comprises three structural layers. Moving from right-to-left in the direction from the exterior toward the interior of hazardous material containment bag 10, outer layer 86 forms the outer surface of backing substrate 12, and thus also forms part of or the entire exterior surface of hazardous material containment bag 10. Moving inward, the next layer is an absorbent layer 88 that forms a part of or all of absorbent body 14, and is adjacent to outer layer 88. Further inward is an inner layer 89 that is adjacent to absorbent layer 88 (i.e., adjacent to absorbent body 14), and is the nearest layer of the multi-layered structure layer to any human remains when placed in hazardous material containment bag 10.

Each layer 86, 88 and 89 can have therein an active agent that is capable of absorbing, adsorbing, neutralizing, deactivating and/or destroying a chemical, biological, radiological, and/or toxicological agent. It should be understood that each layer can, in fact, be two or more tissue layers that form a pocket for containing the active agent.

As used in this application, a "pocket" means a space formed between two layers of material to hold documents or personal items belonging to the decedent, as in pocket 145 in FIGS. 1, 2, 4, 5 and 12 above, but "pocket" also means any area or space formed between two layers of materials, such as the space between two adjacent tissue layers in absorbent body 14, which can enclose and hold an active agent in position.

In certain embodiments, each layer 86, 88 and 89 have a different active agent, i.e., one for adsorbing, absorbing, neutralizing, deactivating and/or destroying a chemical agent, a biological agent, a radiological agent and/or a toxicological agent. In another embodiment, a plurality of layers 86, 88 and 89 (or all of them) have a different active agent for adsorbing, absorbing, neutralizing, deactivating and/or destroying a chemical agent. As will also be appreciated, the configuration and number of layers (e.g., two, three, four, five, six, or seven layers, where the number of layers can be larger where a microlayer is used) provides for essentially unlimited options for forming hazardous material containment bag 10, thereby optimizing the purpose or use for a particular hazardous material containment bag 10.

As noted above, hazardous material containment bag 10 has a matrix of structural layers and active agent(s) that can be configured to provide optimal effectiveness, flexibility and adaptability to minimize contamination by a chemical, biological, radiological and/or toxicological agent. Again, each adjacent pair of layers can form a pocket therebetween to contain an active agent or each layer can have two or more tissue layers that form a pocket for containing an active agent.

The structural layers of materials in hazardous material containment bag 10 can be configured to control: the number of layers; the type of material used to construct each layer; whether each layer has one or more separate (unbounded) sub-layers or that two or more of the sub-layers are bonded together to form a laminate layer; the thickness of each layer; the spacing between adjacent layers or such spacing to form one or more pockets; and one or more coatings or treatments (e.g., urethane coating, surfactant) on or in each layer. The different structural layers can provide different physical or chemical barrier properties that prevent or at least reduce the contaminant from permeating through hazardous material containment bag 10 to contaminate the bearers and the nearby environment.

Hazardous material containment bag 10 can also have one or more active agents. Each active agent is a chemical compound that is present in and/or on any layer, or in a pocket formed between two layers. Upon contact with a contaminant, the active agent can chemically neutralize the contaminant, and/or can chemically alter the contaminant to create a less-toxic compound, and/or absorb or adsorb the contaminant to trap the contaminant within its physical structure. Any one or more of these mechanisms can be employed by the active agent to prevent or at least reduce the contaminant from permeating through hazardous material containment bag 10 to contaminate the bearers and the nearby environment.

In an embodiment, hazardous material containment bag 10 has a "base" (or "generic") structure that is a matrix constructed to incorporate at least "primary" factors that minimize contamination by a known profile of chemical, biological, radiological and/or toxicological agents. The primary factors include, but are not limited to, the number of structural layers, the materials used to form each structural layer, the type and amount of an active agent, and the distribution of the active agent in and/or on the structural layers. Thus, this "base" embodiment can be employed where the contaminant is already identified or is believed to be within the profile of chemical, biological, radiological and/or toxicological agents that can be successfully controlled.

In another embodiment, the "base" structure above can be enhanced by incorporating one or more "secondary factors" including, but not limited to, the space between adjacent layers, a coating applied to a structural layer, the total amount of the active agent and/or the ratio of the amount of the active agent to the basis weight of the structural layers.

Alternatively, the "base" embodiment of hazardous material containment bag 10 can be employed as a general precaution to minimize contamination in a hostile environment where a specific threat of chemical, biological, radiological and/or toxicological agents has not yet been identified.

In another embodiment, hazardous material containment bag 10 has a "targeted" matrix that is constructed to incorporate at least the "primary" factors that minimize contamination by a particular profile of chemical, biological, radiological and/or toxicological agents. Depending on the identity and concentration of the contaminant, one or more of the "secondary" features can be enhanced as well. For example, if hazardous material containment bag 10 is to be deployed where there is suspicion that toxic chemical weapons were used, hazardous material containment bag 10 can be specially constructed to have a matrix that targets the particular toxic chemical agents by adding an additional laminated structural layer that increases the physical barrier to penetration by that toxic chemical, and/or by adding an active agent that will interact with the toxic chemical agent. This targeted matrix permits safe enclosure and transport of human remains or contaminated materials in hazardous material containment bag 10. When a layer of absorbent material 14 is in non-fibrous material form, e.g., as a sheet of material, the active agent can be applied similar to the methods described above with respect to fibers of the fibrous material. Also, the sheet should preferably have a porous structure so that the chemical, biological, radiological and/or toxicological agent may pass through to contact the layer having an active agent to adsorb, absorb, neutralize, deactivate and/or destroy the particular chemical, biological, radiological and/or toxicological agent.

The active agent can be added to an embodiment of absorbent body 14 made of a fibrous material by applying the active agent to the surface of the fibers of the fibrous material, such as by immersion in a solution of an active agent and thereafter drying, so as to leave a residual layer of the active agent adhered to the fibers of the fibrous material. Alternatively, the active agent can be chemically bound to the fibers of the fibrous material of absorbent body 14, and such chemical bounding can include grafting. The layers can be arranged in any order desired. For example, in FIG. 9, layer 78 could have an active agent that is suitable for adsorbing, absorbing, neutralizing, deactivating, and/or destroying a chemical agent. Layer 77 could have an active agent that is suitable for adsorbing, absorbing, neutralizing, deactivating and/or destroying a biological agent. Layer 78 could have an active agent that is suitable for adsorbing, absorbing, neutralizing, deactivating, and/or destroying a toxicological agent. Layer 79 could have an active agent that is suitable for adsorbing, absorbing, neutralizing, deactivating and/or destroying a radiological agent. In other embodiments, as noted above, each layer 76, 77, 78 and 79 could have a plurality of such agents as listed above. Still alternatively, each layer 76, 77, 78 and 79 could have a different active agent for adsorbing, absorbing, neutralizing, deactivating and/or destroying, e.g., a chemical agent.

In an alternative embodiment, a portion of the active agent can be in the form of nanoparticles. Nanoparticles provide, in the aggregate, a very large surface area for the same amount of an active agent as compared with normal-sized particles, thereby increasing exposure and contact of the active agent with hazardous materials that are absorbed, adsorbed, neutralized, deactivated, and/or destroyed by the active agent. In addition, the large surface area of nanoparticles, in the aggregate, can serve as a fine-grade "filtration" area through which hazardous agents pass and are removed, neutralized and/or destroyed.

Any structural layer of hazardous material containment bag 10 can have nanoparticles therein to provide protection against hazardous materials. For example, gold-embedded nanoparticles can be present in or on any structural material used of hazardous material containment bag 10, including backing substrate 12, cover 80 and absorbent body 14. Gold-embedded nanoparticles can protect against contamination by radiological hazards, including alpha and beta particles, and gamma rays, and still allow the structural material in which the nanoparticles are present to remain lightweight.

One or more active agent can be present anywhere on and/or in the one or more layers of absorbent body 14 and/or hazardous material containment bag 10. The active agent is preferably positioned in and/or on, or in-between, any two layers of absorbent body 14. The active agent can minimize infection and contamination by microbial pathogens, and can reduce and/or eliminate odors. The active agent can be, but is not limited to, a bactericide, bacteriostatic agent, fungicide, virucide, disinfectant, sanitizer, sterilizer, mildewstat, surfactant, deodorizer, or any combinations thereof. The active agent can include, but is not limited to: quaternary ammonium salts, surfactants (such as crown ethers), metal or metal compound, organic acid, inorganic acid, salt, sulfite, biopolymer, synthetic polymer, chitin, chitosan, nisin, enzyme, arginate, diacetate, antioxidant, and any combinations thereof. Still other examples of active agents include, but are not limited to, acid/base neutralizers, adsorbent or absorbent materials such as polyoxybenzylmethylenglycolanhydride (BAKELITE®), clay, polymeric scaffolding containing active sites with varying degrees of specificity, trapping agent, and compounds that neutralize biologically-active materials, such as antibodies. The active agent can be present in an active form, or, alternatively, can be present in an inactive form that becomes activated upon contact with liquids or gases.

When a layer of absorbent material 14 is in non-fibrous material form, e.g., as a sheet of material, the active agent can be applied similar to the methods described above with respect to fibers of the fibrous material. Also, the sheet should preferably have a porous structure so that the chemical, biological, radiological and/or toxicological agent may pass through to contact the layer having an active agent to adsorb, absorb, neutralize, deactivate and/or destroy the particular chemical, biological, radiological and/or toxicological agent.

The "architecture" of hazardous material containment bag 10, as well as the choice of the one or more active agent, can be varied depending on the nature of the hazardous material expected to be encountered so as to improve performance. Performance of hazardous material containment bag 10 therefore depends not only on the selection of the active agent, but also the location of the active agent in the hazardous material containment bag 10. Varying the architecture can regulate the length of time before the active agent is activated or exposed to hazardous materials. Also, the architecture can be designed to physically separate individual chemical components of a "system" of two or more components of active agent, in order to provide extended release, delayed release, controlled release, or sustained release of the active agent in hazardous material containment bag 10.

Figure 11:
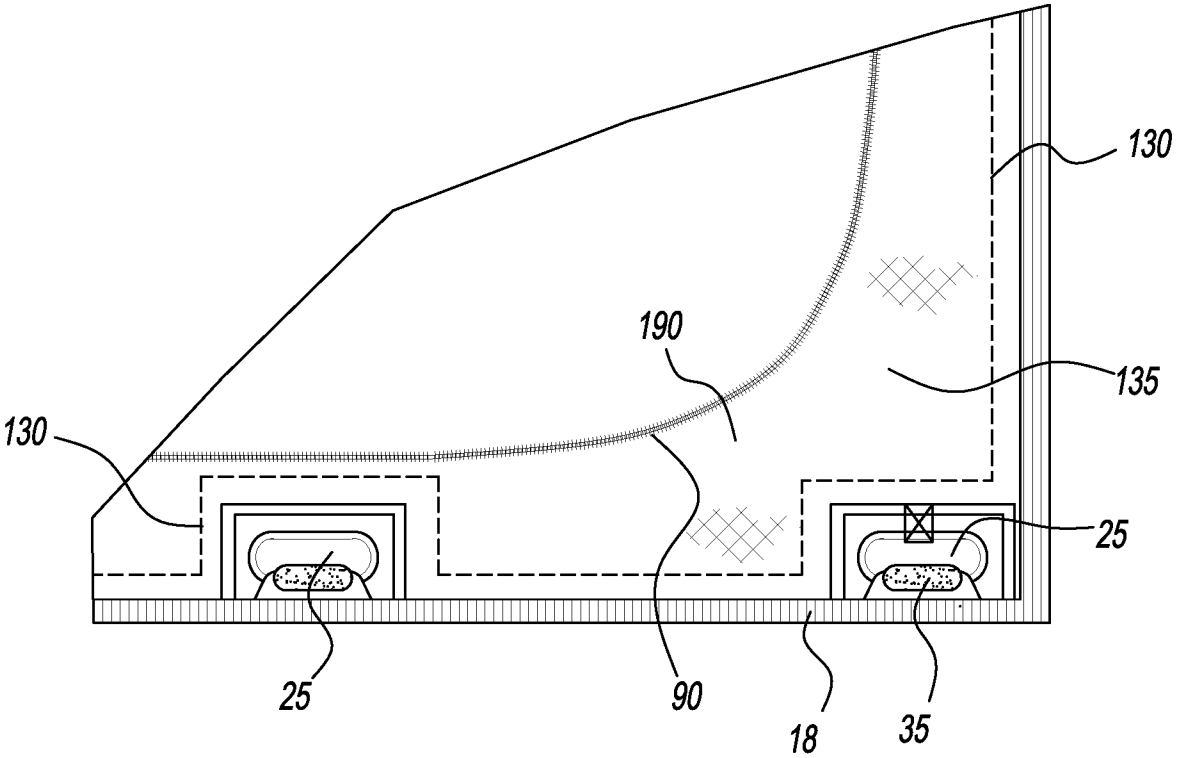
FIG. 11 shows an exploded sectional view of reinforced gripping devices of the embodiment of the hazardous material containment bag in FIG. 2.
Figure 12:
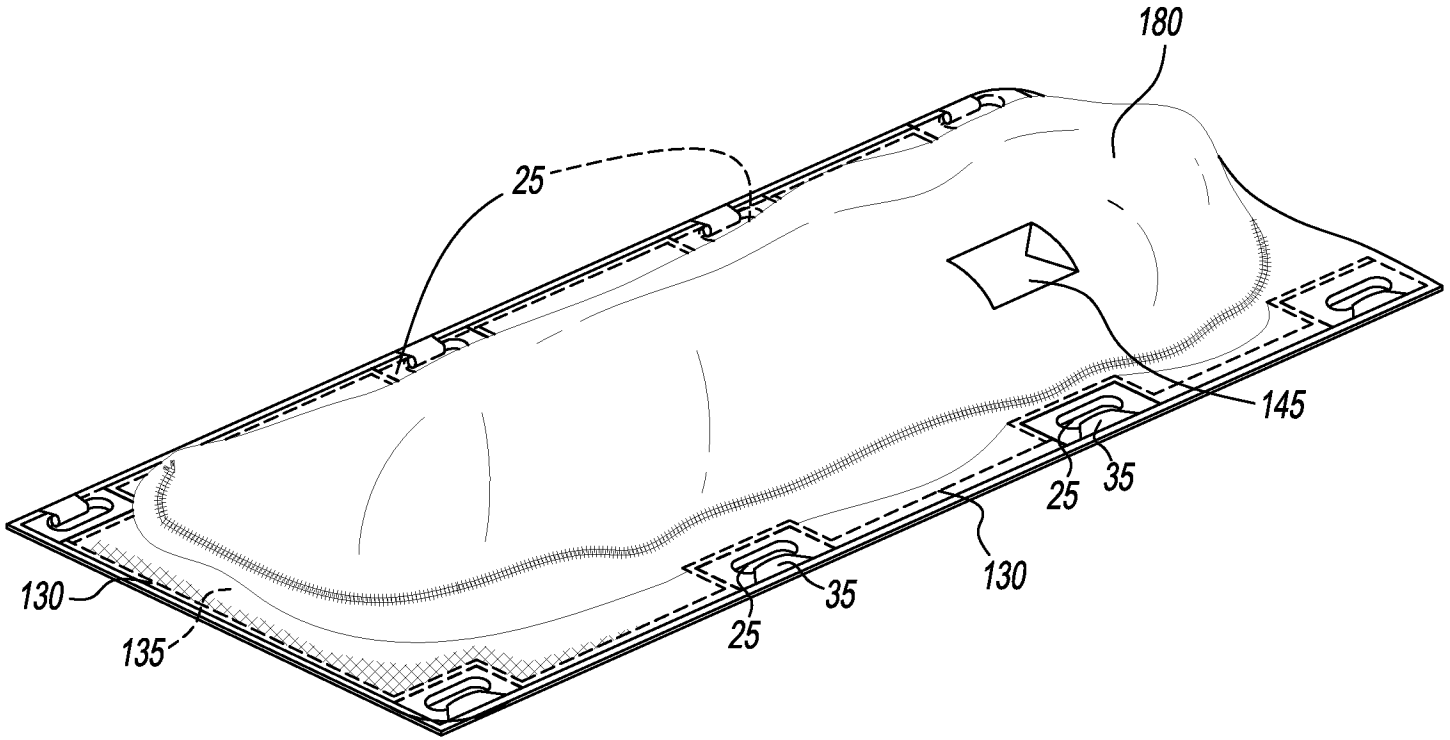
FIG. 12 shows a perspective view of the embodiment of the hazardous material containment bag with a decedent's body therein of FIG. 2.

FIG. 11 shows a close up view of gripping device 25 with reinforcement piece 35 and also shows an embodiment where closure 90 is a zipper that has a sealing material 190 along its length to provide water-resistance to closure 90. Similar to closure 115, closure 90 can also be a YKK Aquaseal zipper. However, closure 90 need not be a zipper and can be any type of closure that provides a tight chemical closure. To further increase water-resistance of closure 90, the closure can have a water-resistant "landing zone" (not shown) when recloseable flap 140 is closed, which also secures closure 90 to the containment bag structure. For security, closure 90 can be sealed with tie seals, or a lock, for security and to maintain a positive seal between closure 90 and the containment bag. The one or more gripping devices 25 connected to backing substrate 12 and cover 80 can be pass-through holes (as illustrated in FIG. 12), straps, eyelet loops, or any other device for one or more bearers to grip and transport hazardous material containment bag 10. For greater comfort or ease of carrying hazardous material containment bag 10, such as when the bearers are wearing safety gloves, gripping devices 25 can be proportionately larger than shown in FIGS. 1 to 4, to allow more room for the hand of the bearer. FIG. 11 also shows a portion of thermal seal 130 along a perimeter of hazardous material containment bag 10 that is contoured around a gripping device 25, so that the gripping devices 25 are external to compartment 135 (i.e., an interior volume between backing substrate 12 and cover 80) formed by thermal seal 130. FIG. 11 also shows a portion of binder material 18 along an outer edge of hazardous material containment bag 10.

Gripping devices 25 can be positioned anywhere along the perimeter structure of hazardous material containment bag 10, such as at the edges and/or along the sides of the hazardous material containment bag. Gripping devices 25 are preferably handholds (holes) that are positioned symmetrically along the ends and/or along the sides of hazardous material containment bag 10. However, any gripping device 25 can also be a strap, eyelet loop, or any other device passing through backing substrate 12. Each gripping device 25 permits manual gripping and lifting by a person serving as a carrier of hazardous material containment bag 10, or insertion of one or more rigid structures, such as poles, or any combinations of these, to enhance the ease of carrying hazardous material containment bag 10 with human remains or a hazardous material therein. Hazardous material containment bag 10 has one or more gripping devices 25, and preferably has two to ten gripping devices 25 positioned at any location of hazardous material containment bag 10. Another embodiment has four to eight gripping devices 25 positioned along the perimeter of hazardous material containment bag 10.

Reinforcement piece 35 is a separate piece of material having high-tensile properties, including, but not limited to, polyvinyl chloride, two-sided urethane-coated materials, polyesters, polypropylene, or any combinations thereof.

Referring to FIG. 12, an embodiment of hazardous material containment bag 10 having human remains 180 (also called "the decedent's body" in this application with the same meaning) placed therein is shown. In this embodiment, pocket 145 is shown on the second side 82 (external surface) of cover 80. FIG. 12 also shows thermal seal 130, and indicates compartment 135 (in the interior of hazardous material containment bag 10) that is formed by thermal seal 130.

Chemical agents include those known for use in chemical warfare and involve using the toxic properties of chemical substances as weapons. This type of warfare is distinct from nuclear warfare and biological warfare, which together make up NBC, the military acronym for nuclear, biological, and chemical (warfare or weapons), all of which are considered "weapons of mass destruction" (WMD). None of these WMD fall under the term conventional weapons that are primarily effective due to their destructive potential. Chemical warfare does not depend upon explosive force to achieve an objective. Rather, it depends upon the unique properties of the chemical agent weaponized. A lethal agent is designed to injure or incapacitate the enemy, or deny unhindered use of a particular area of terrain. Defoliants are used to quickly kill vegetation and deny its use for cover and concealment. It can also be used against agriculture and livestock to promote hunger and starvation. Many nations possess vast stockpiles of weaponized agents in preparation for wartime use. The threat and the perceived threat have become strategic tools in planning both measures and countermeasures.

Lethal chemical agents include blood agents, such as cyanogen chloride (CK) and hydrogen cyanide (AC), blister agents such as ethyldichloroarsine (ED), methyldichloroarsine (MD), phenyldichloroarsine (PD), Lewisite (L), sulfur mustard (HD, H, HT, HL and HQ) and nitrogen mustard (HN1, HN2 and HN3), nerve agents such as G-agent, Tabun (GA), Sarin (GB), Soman (GD), Cyclosarin (GF) and phosgene oxime (CX), pulmonary agents such as chlorine, chloropicrin (PS), phosgene (CG) and diphosgene (DP), incapacitating agents such as agent 15 (BZ), dimethylheptylpyran (DMHP), EA-3167, Kolokol-1, PAVA spray and sleeping gas.

A biological agent that can be controlled by hazardous material containment bag 10 includes a bacterium, virus, protozoan, parasite, or fungus that can be used purposefully as a biological weapon in bioterrorism or biological warfare (BW). In addition to these living and/or replicating pathogens, biological agents (toxins) are also included. More than 1,200 different kinds of potentially weaponizable biological agents have been described and studied to date. Biological agents have the ability to adversely affect human health in a variety of ways, ranging from relatively mild allergic reactions to serious medical conditions, including death. Many of these organisms are ubiquitous in the natural environment where they are found in water, soil, plants or animals. Biological agents can be amenable to "weaponization" to render them easier to deploy or disseminate. Genetic modification can enhance their incapacitating or lethal properties, or render them impervious to conventional treatments or preventives. Since many biological agents reproduce rapidly and require minimal resources for propagation, they are also a potential danger in a wide variety of occupational settings.

Known biological agents include anthrax, plague, cholera, Rocky Mountain spotted fever, typhus, equine encephalitis smallpox, botulism toxin, and ricin, among others.

Radioactive contamination, also called radiological contamination, is the deposition of, or presence of, radioactive substances on surfaces or within solids, liquids or gases (including the human body), where their presence is unintended or undesirable. Such contamination presents a hazard because of the radioactive decay of the contaminants, which emit harmful ionizing radiation such as alpha particles or beta particles, gamma rays or neutrons. The degree of hazard is determined by the concentration of the contaminants, the energy of the radiation being emitted, the type of radiation, and the proximity of the contamination to organs of the body. It is important to be clear that the contamination gives rise to the radiation hazard, and the terms "radiation" and "contamination" are not interchangeable.

A sampling of radioactive materials shows that most materials are useful and improve the human experience, but present dangers if present in too high concentration or are uncontained. Americium-241 (used in smoke detectors, to measure levels of toxic lead in dried paint samples, to ensure uniform thickness in rolling processes like steel and paper production, and to help determine where oil wells should be drilled), Cadmium-109 (to analyze metal alloys for checking stock and sorting scrap), Calcium-47 (important aid to biomedical researchers studying the cell function and bone formation of mammals), Cesium-137 (used to treat cancers, to measure correct patient dosages of radioactive pharmaceuticals, to measure and control the liquid flow in oil pipelines, to tell researchers whether oil wells are plugged by sand, and to ensure the correct fill level for packages of food, drugs and other products), Iodine-131 (used to diagnose and treat thyroid disorders). On the other hand, with overexposure or uncontrolled release, these materials can be dangerous or fatal. For example, Cesium-137 was a primary contaminant in the nuclear accident in Japan in 2011, and Iodine-131 concentrates in the thyroid upon exposure to excess levels and can cause thyroid dysfunction or cancer.

"Contaminant" as used in this application means a chemical, biological, radiological and/or toxicological agent, such as those agents described above.

Hazardous material containment bag 10 must be strong enough to hold the weight of a human body without breaking, even when transported over a great distance or exposed to inclement weather. The hazardous material containment bag 10 should be sufficiently large to completely enclose the decedent's body to conceal it from public view, and yet be sufficiently lightweight so as to be readily portable. Moreover, the outer shell of surface of the containment bag 10 must be able to resist decontamination procedures that are normally employed once the decedent's body is placed therein and before the containment bag 10 can be moved to another location.

"Lightweight" as used in this application means that hazardous material containment bag 10 has a total weight that is less than about 8 pounds, preferably has a total weight that is less than 7 pounds, and more preferably has a total weight that is about 6.6 pounds (2.99 kg).

Hazardous material containment bag 10 is strong enough to support carrying human remains or hazardous materials that weigh up to about 420 pounds (190.5 kg) to about 450 pounds (204.1 kg), whether hazardous material containment bag 10 is wet or dry.

When not in use, hazardous material containment bag 10 can be folded to a compact, portable size to be easily carried by a single person. Portability and reduced storage space requirements can be further enhanced by folding hazardous material containment bag 10 and placing the bag in a case that has some or all of the air removed by vacuum or negative pressure. This also reduces the likelihood of contamination, absorption of ambient moisture by absorbent body 14, or premature activation of active agents in hazardous material containment bag 10 prior to use.

The outer dimensions of an embodiment of outer dimensions of an embodiment of hazardous material containment bag 10 are at least eighteen (18) inches in width and at least sixty-five (65) inches in length. A preferred embodiment of hazardous material containment bag 10 has outer dimensions that are about thirty-three and a half (33.5) inches in width by about seventy-eight (78) inches in length. A more preferred embodiment of hazardous material containment bag 10 has outer dimensions that are about thirty-six (36) inches (91 cm) in width by about ninety-one (91) inches (231 cm) in length.

Alternative embodiments of hazardous material containment bag 10 of the present disclosure have smaller outer dimensions that can hold and carry bodies of decedents who are children or small adults. An embodiment of hazardous material containment bag 10 of a smaller size has outer dimensions of about thirty-three (33) inches in width by about sixty (60) inches in length. A still smaller embodiment of hazardous material containment bag 10 has outer dimensions of about twenty (20) inches in width by about thirty-six (36) inches in length. A still smaller embodiment has outer dimensions of about twenty (20) inches in width by about fifteen (15) inches in length.

The smaller-dimensioned hazardous material containment bag 10 can hold and carry detached body parts, such as after an autopsy or an explosion.

Hazardous material containment bag 10 can enclose and/or transport the bodies of animals that have died, including, but not limited to, dogs, cats, birds, mice and other rodents, raccoons, squirrels, rabbits, deer, monkeys, and chimpanzees. Hazardous material containment bag 10 can transport animals that are killed on roads, as well as transport research animals that have died.

The overall thickness of hazardous material containment bag 10 (before use) is preferably about 0.125 inches ($1/8^{th}$ inch) (0.32 cm).

Figure 13:
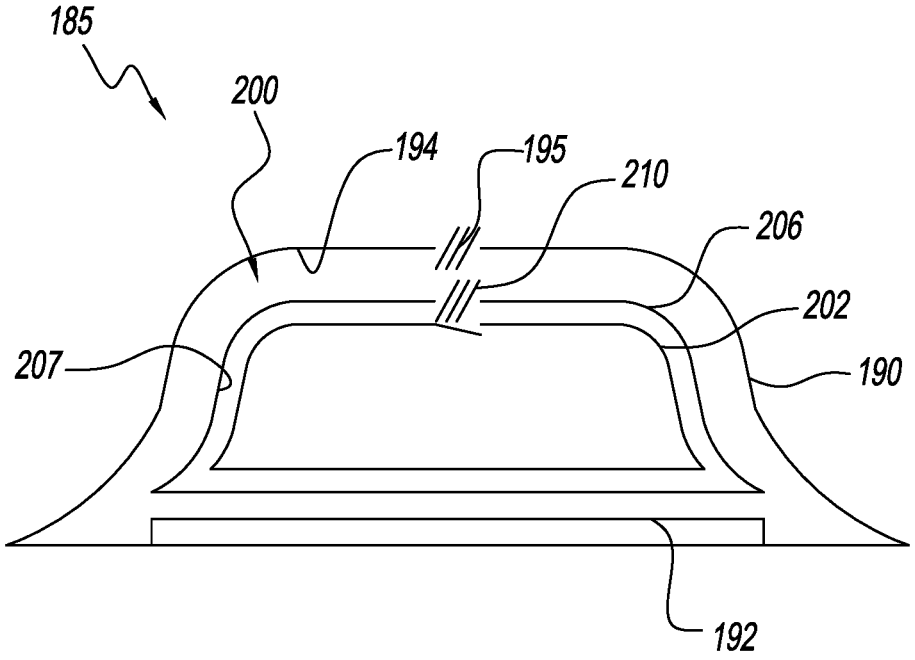
FIG. 13 is a cross-sectional view of a second embodiment, namely a modular hazardous remains system, of the present disclosure taken along line 13-13 of FIG. 19.

As shown in FIG. 13, a second embodiment of the present disclosure is a modular hazardous remains bag or system 185 having an outer bag 190 that is discrete and separate from an inner bag 200. Contaminated material is placed inside inner bag 200, which is then placed inside outer bag 190.

Outer bag 190 provides physical stability to system 185. Outer bag 190 can be used universally with any inner bag 200. Inner bag 200 is designed to provide specific protection against specific threats. By providing specific inner bags 200 related to the specific threat involved, an individual or company that constantly deals with particular threats can purchase inner bags 200 designed to neutralize and contain only those threats. Additionally, if a new threat is developed in the future, inner bags 200 can be specifically designed to neutralize or contain the new threat, while easily being implemented into system 185.

In addition to physical stability, outer bag 190 provides leak protection and abrasion resistance. Any material that can provide strength and durability can be used for outer bag 190. Preferably, outer bag 190 is a 200 denier nylon with a polyurethane or similar backing.

Outer bag 190 can have an absorbent core 192 to contain any liquid and/or gas that may escape from inner bag 200 when inner bag 200 is in outer bag 190. Absorbent core 192 can extend around, and thus, line the entire inner surface 194 of outer bag 190. Preferably, absorbent core 192 is positioned only at a bottom of the interior volume of outer bag 190.

Similar to the embodiments described in FIGS. 1-12, outer bag 190 preferably has gripping devices (not shown) on opposite sides of outer bag 190. Gripping devices of outer bag 190 can be the same as gripping devices 25.

Figure 20:
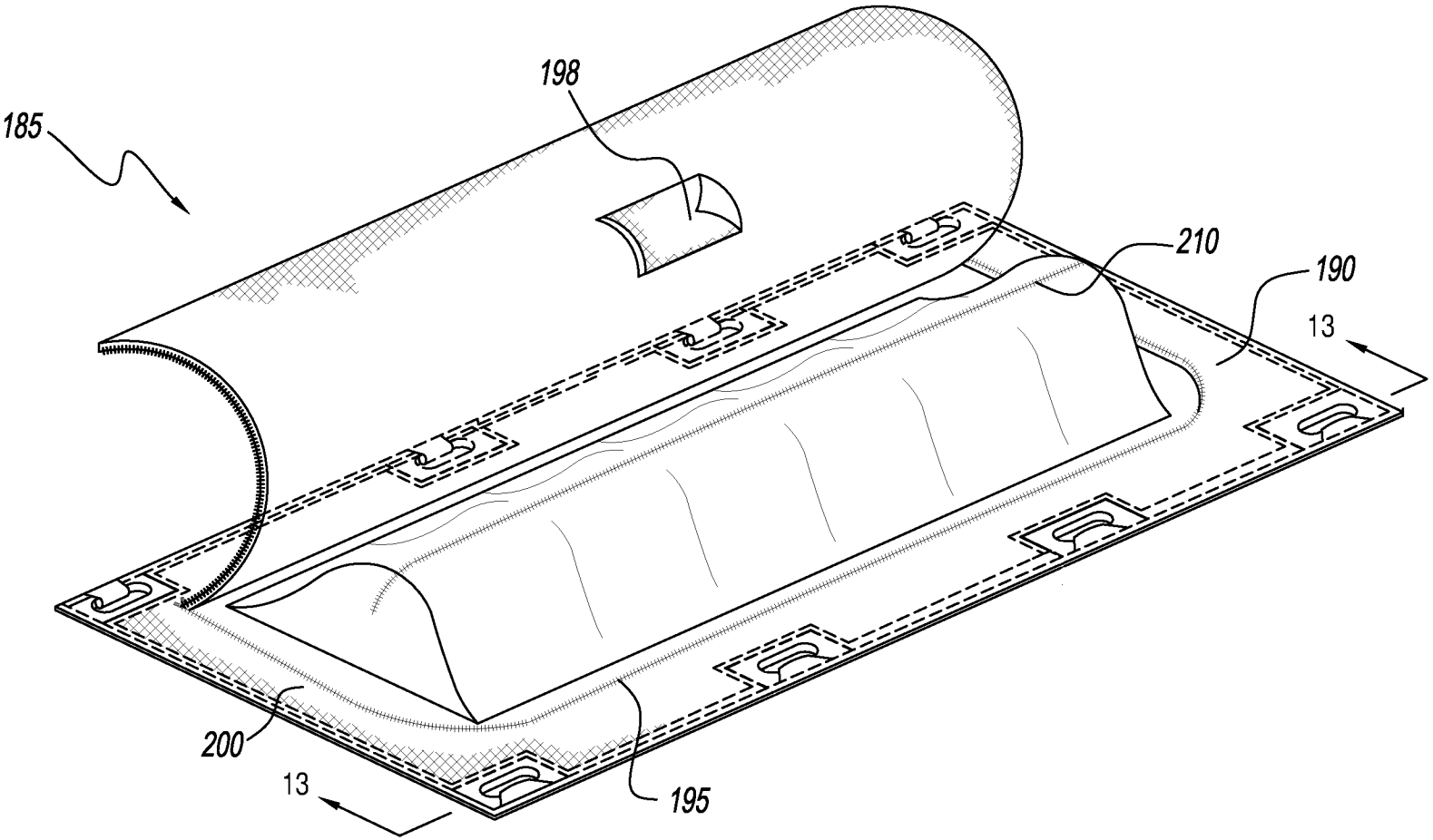
FIG. 20 is a perspective view of the system of FIG. 13.

As shown in FIG. 20, outer bag 190 can have a pocket 198 located on any outer surface. Pocket 198 is the same as pocket 145 described above.

Outer bag 190 is sized to accommodate any remains in the 95th percentile weight. Specifically, outer bag 190 has dimensions of approximately thirty-six (36) inches in width by approximately ninety-one (91) inches in length. Alternative embodiments of outer bag 190 of the present disclosure can have smaller outer dimensions that can accommodate bodies of decedents who are children or small adults, or larger dimensions for large adults.

Outer bag 190 has a closure 195. Closure 195 provides access to the inside volume of outer bag 190. Preferably, closure 195 is a zipper that has the same properties of closure 125.

Figure 14:
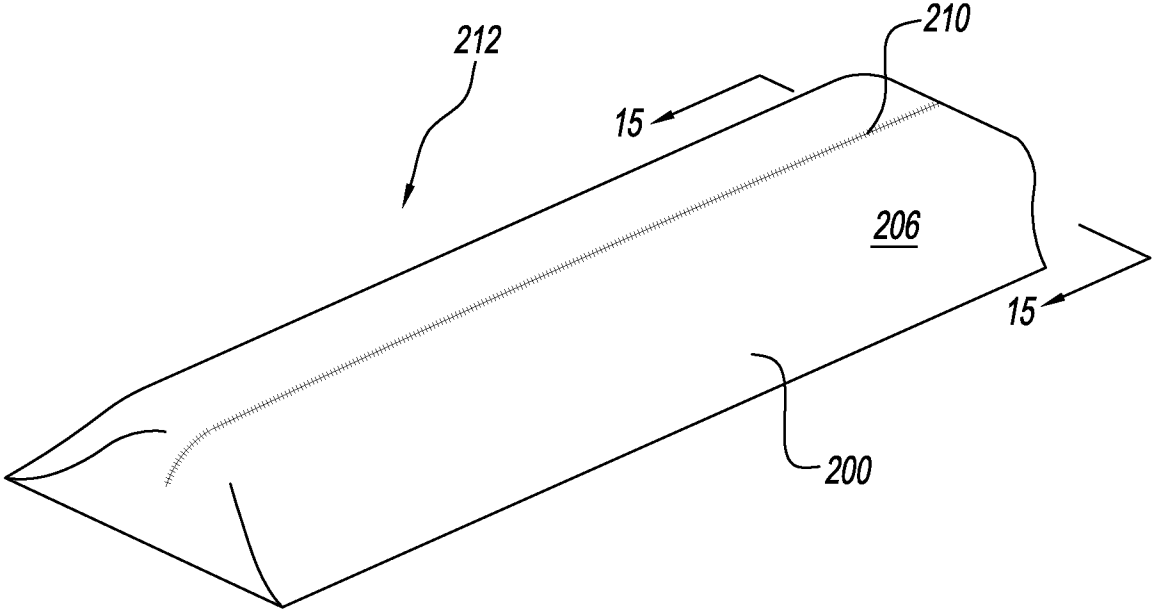
FIG. 14 is a perspective view of a biological inner bag of the system of FIG. 13.
Figure 15A:
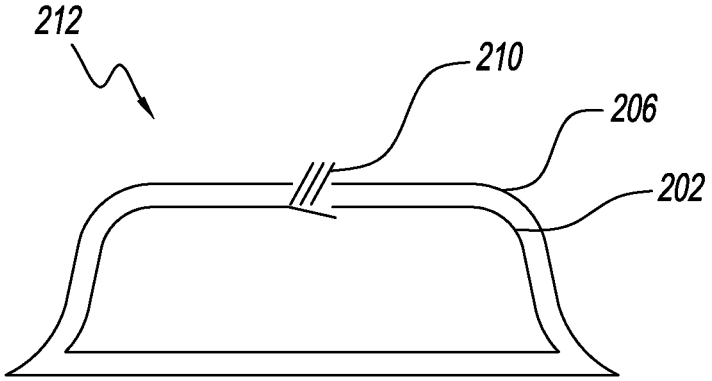
FIG. 15(*a*) is a cross-sectional view of the biological containment inner bag of FIG. 14 taken along line 15-15 of FIG. 14.
Figure 15B:
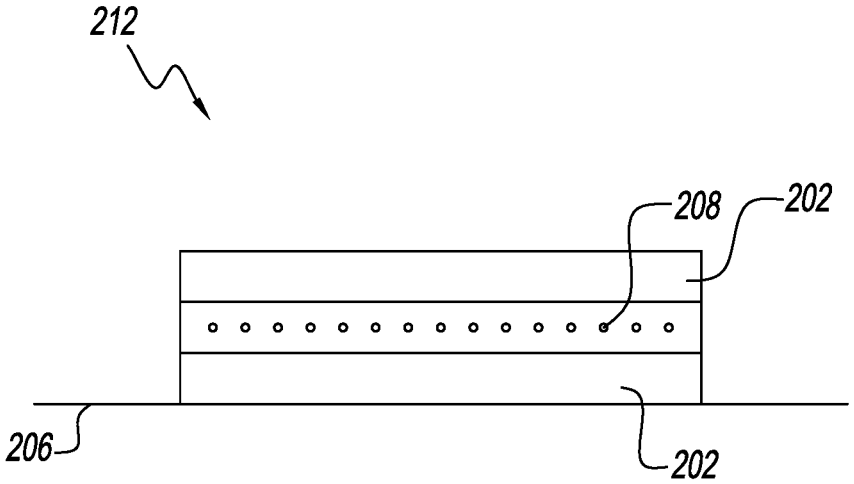
Figure 16:
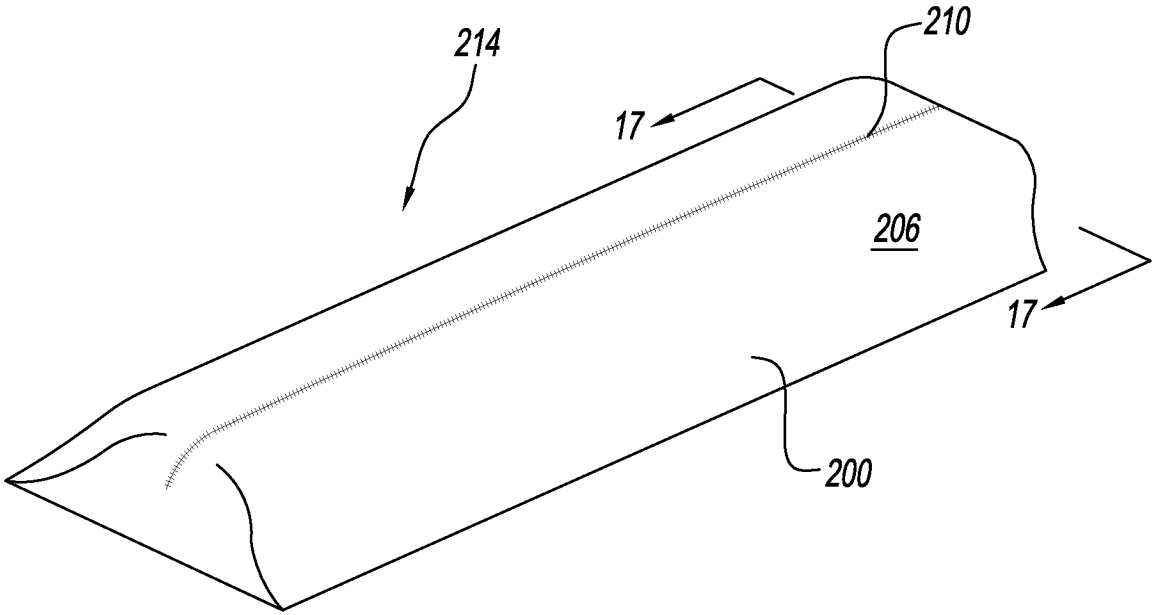
FIG. 16 is a perspective view of a chemical inner bag of the system of FIG. 13.
Figure 17A:
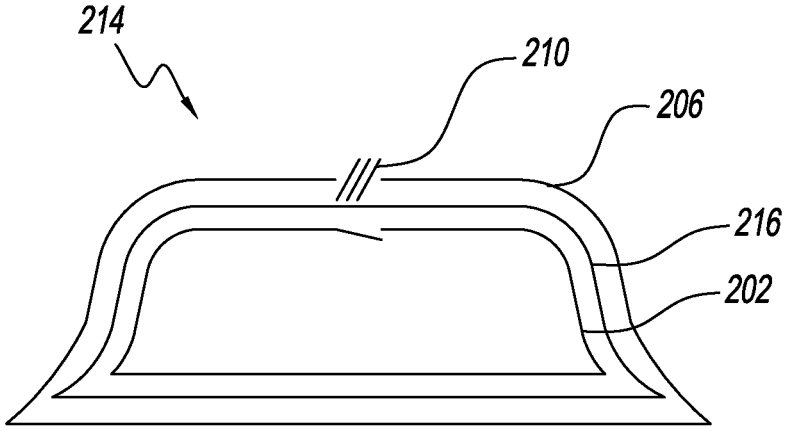
FIG. 17(*a*) is a cross-sectional view of the chemical containment inner bag of the system of FIG. 13 taken along line 17-17 of FIG. 16.
Figure 17B:
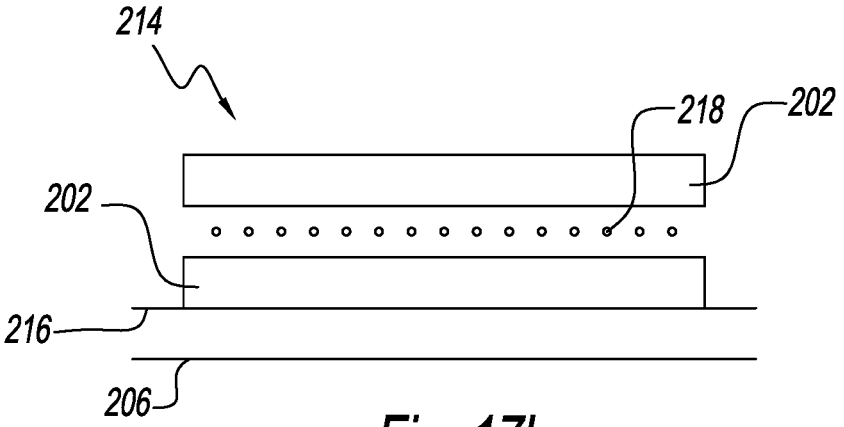
Figure 17D:
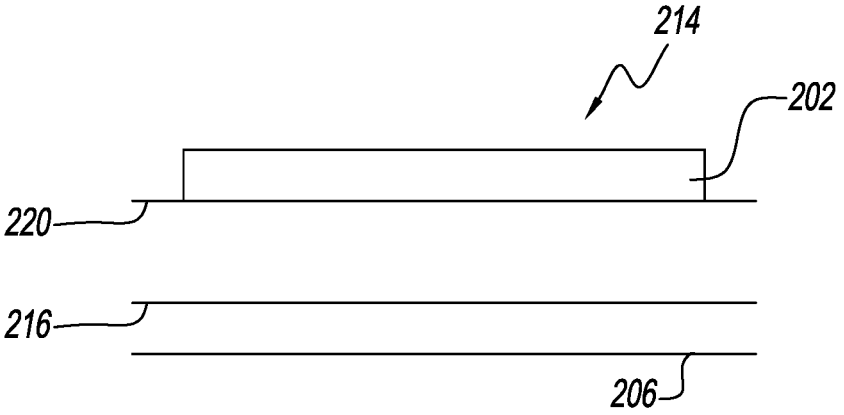
Figure 17C:
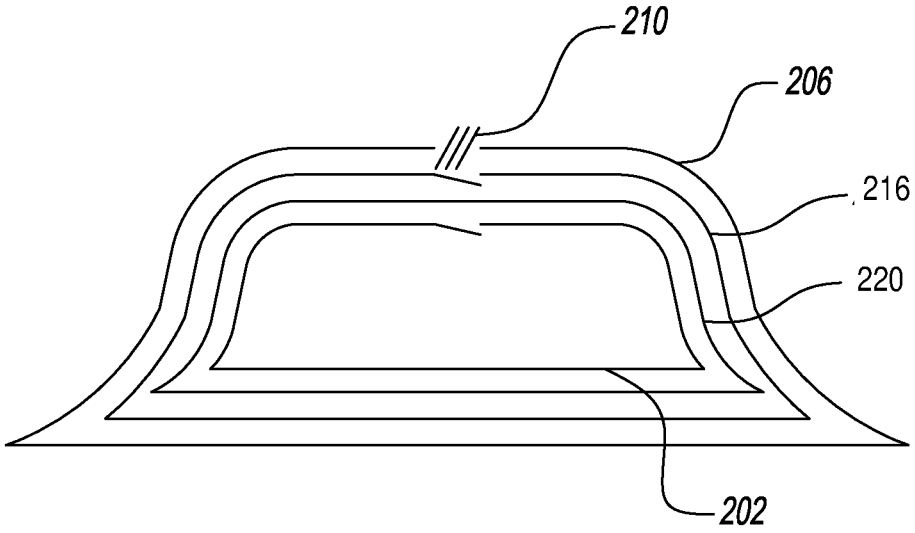

FIGS. 14 and 16 show inner bag 200 generally. FIGS. 15(*a*), 15(*b*), and 17(*a*)-(*d*) show inner bag 200 in more detail, and also show details of different embodiments of inner bag 200, each explained in detail below.

Inner bag 200 has several layers designed to provide control and protection against specific hazards. Inner bag 200 has an absorbent core 202 made up of one or more airlaid layers of cellulose deposited on a carrier material, such as a tissue or polymer. Alternatively, absorbent core 202 can be a combination of cellulose and SAP in order to better contain the moisture inside inner bag 200.

Absorbent core 202 can have one or more active agents therein. The particular active agent used is tailored to the specific threat to be neutralized or contained. The active agent can be selected from one or more antimicrobials, neutralizers, nanoparticles, or any of the other active agents listed in the present disclosure. An example of an antimicrobial is a quaternary ammonium salt, though any inorganic antimicrobial that will be activated with liquids, and any other organic compound that will disrupt cell membrane or reproduction in microorganisms, can be used instead or in addition to a quaternary ammonium salt. Additionally, active agent can be two or more precursors that form an antimicrobial gas when activated by water.

An outer layer 206 of inner bag 200 must have enough physical stability to avoid damage when adding the contaminants therein, and also when inserting inner bag 200 into outer bag 190. Further, outer layer 206 has thermal heating properties since it has to be welded to prevent leakage.

Absorbent core 202 of inner bag 200 extends around, and thus, lines all or part of inner surface 207 of outer layer 206. Preferably, absorbent core 202 lines all of inner surface 207 to inhibit the escape of any gases and/or liquids from inner bag 200.

A suitable material for outer layer 206 is thermal polyurethane, which can optionally be laminated to nylon. The preferred thickness of the outer layer 206 is in the range of 5 mils-10 mils, but can be have a different thickness if laminated to nylon.

Inner bag 200 has a closure 210. Closure 210 provides access to the inside volume of inner bag 200. As explained in more detail below, closure 210 is designed to complement the specific use of inner bag 200.

Figure 18:
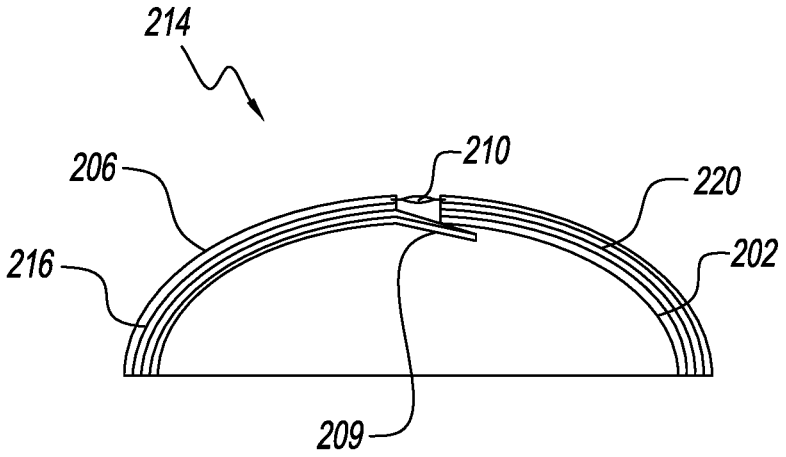
FIG. 18 is a cross-sectional view of the inner bag of the system of FIG. 13.
Figure 19:
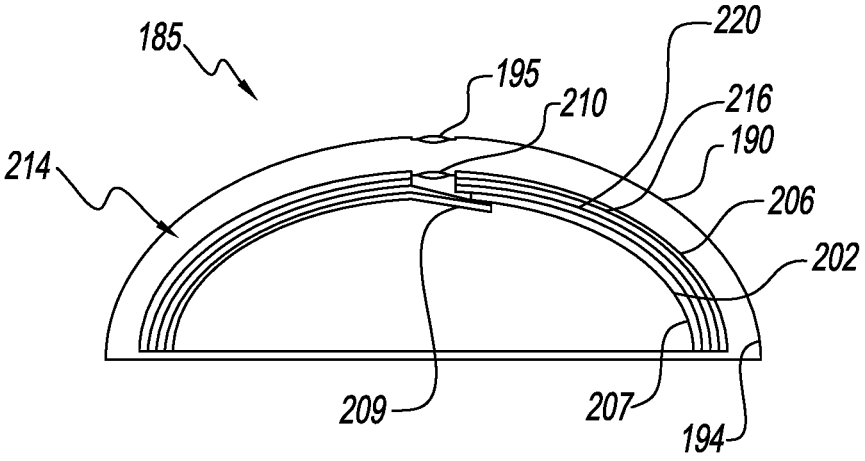
FIG. 19 is a cross-sectional view of the system of FIG. 13.

Preferably, absorbent core 202 defines a lip 209 that overlaps closure 212 to inhibit the escape of gases and/or liquids through closure 212. Although the lip 209 is shown in FIGS. 18 and 19 for a specific embodiment, it should be understood that lip 209 can be incorporated into all embodiments of the present disclosure.

A specific example of inner bag 200 that is designed for biological containment is represented by reference numeral 212 and is shown in FIGS. 14, 15(*a*) and 15(*b*). Biological containment bag 212 has absorbent core 202, with an antimicrobial chemical 208 disposed therein. Biological containment bag 212 further has outer layer 206 laminated to absorbent core 202. Outer layer 206 is preferably a thermal polyurethane laminated to nylon. For this embodiment, closure 210 is preferably YKK Aqua Seal VFW-B.

A specific example of inner bag 200 that is designed for chemical containment is represented by reference numeral 214 and is shown in FIGS. 16, 17(*a*), 17(*b*), 17(*c*), 17(*d*) and 18. FIGS. 17(*b*) and 17(*d*) show alternative embodiments of chemical containment bag 214. FIG. 19 shows chemical containment bag 214 enclosed within outer bag 190 in the context of system 185.

For the embodiment shown in FIGS. 17(*a*)-(*b*), chemical containment bag 214 has absorbent core 202 with active carbon 218 therein. Active carbon 218 is in powdered form in absorbent core 202. In addition to, or instead of, active carbon 218, other gas absorbing materials, such as clays or zeolites, can be used. This embodiment also has a chemical barrier 216 laminated to absorbent core 202, and outer layer 206 that is positioned adjacent to chemical barrier 216.

Chemical barrier 216 in conjunction with absorbent core 202 and active carbon 218 ensures that chemicals are contained in chemical containment bag 214. Chemical barrier 216 controls or slows the rate diffusion of a given chemical to enhance how absorbent core 202 and active carbon 218 work together. Chemical barrier 216 has the capability of containing both liquids and gases inside chemical containment bag 214. Chemical barrier 216 has a low oxygen transmission rate of approximately 0.75 to 0.05 $cm^3/in^2/day$. Suitable materials for chemical barrier 216 are coextruded multi-layered films, fluoropolymers, or similar films with a suitable oxygen transmission rate and chemical barrier properties.

For the embodiment shown in FIGS. 17(*c*)-(*d*), chemical containment bag 214 has a layer 220 that is carbon cloth. Layer 220 serves the same function as the active carbon 218 in the embodiment of FIG. 17(*b*). The carbon cloth for layer 220 is commercially available through Calgon and sold under the trade name Zorflex. Layer 220 can be laminated to absorbent core 220 with a suitable poly vehicle, such as polyethylene or polypropylene, depending on the specific properties to be obtained. This embodiment has chemical barrier 216 adjacent layer 220, and outer layer 206 adjacent chemical barrier 216. For this embodiment, closure 210 is preferably YKK 8TZ-PU or YKK Aqua Seal VFW-B.

Inner bag 200 can be made in different sizes to accommodate a particular user so long as the overall dimensions of inner bag 200 fit within outer bag 190. Preferably, inner bag 200 can be approximately 28-30 inches in width by approximately 83-85 inches in length. Alternative embodiments of inner bag 200 of the present disclosure can have smaller outer dimensions that can accommodate bodies of decedents who are children or small adults, or larger dimensions for large adults.

The present disclosure also provides a method of using a hazardous material containment bag 10 that includes the following steps. Hazardous material containment bag 10 is removed from the case (if packaged before use) and unfolded. Closure 90 is opened to permit access to the interior of hazardous material containment bag 10. A decedent's body or a hazardous material (such as a material or person contaminated by a chemical, biological, radiological or toxicological agent) is placed in hazardous material containment bag 10. Cover 80 is pulled over the decedent's body to cover the body. Closure 90 is closed to completely enclose the body. Hazardous material containment bag 10, with the human remains or hazardous material enclosed therein, can then be lifted and/or carried by one or more bearers who manually grip and lift hazardous material containment bag 10 by gripping devices 25 or by inserting rigid poles 28 through the gripping devices 25. This can also be achieved by employing a mechanical device to lift hazardous material containment bag 10. The bearers then transport hazardous material containment bag 10, with the decedent's body or the hazardous material therein, for a desired distance.

The present disclosure also provides a method of using the hazardous material containment bag 100 shown in FIGS. 5-7 and includes the following steps. Hazardous material containment bag 100 is removed from the case (if packaged before use) and unfolded. Closure 125 on outer shell 120 is opened to permit access to inner shell 110. Closure 115 is opened to provide access to the interior volume of inner shell 110. A decedent's body or a hazardous material is placed in inner shell 110. Closure 115 is closed to completely enclose the decedent's body or hazardous material therein. Closure 125 is closed to close outer shell 120 and completely enclose inner shell 110 therein. In the embodiment where inner shell 110 is not attached to outer shell 120 (not shown), the steps of the method are the same, except that an additional step of placing inner shell 110 inside outer shell 120 is required before outer shell 120 is closed via closure 125. Hazardous material containment bag 100, with the human remains or hazardous material enclosed therein, can then be lifted and/or carried by one or more bearers who manually grip and lift hazardous material containment bag 100. This can also be achieved by employing a mechanical device to lift hazardous material containment bag 100. The bearers then transport hazardous material containment bag 100, with the decedent's body or the hazardous material therein, for a desired distance.

The present disclosure also provides a method of using modular hazardous remains system 185 shown in FIGS. 13-20. This method includes the following steps. Outer bag 190 is removed from the case (if packaged before use) and unfolded. Closure 195 on outer bag 190 is opened to permit access to an interior volume of outer bag 190. Closure 210 on inner bag 200 is also opened to permit access to an interior volume of inner bag 200. Contaminants or human remains are placed inside inner bag 200. Inner bag 200 is then closed via closure 210 to completely enclose the contaminants or human remains within inner bag 200. Inner bag 200 is then placed inside outer bag 190. Outer bag 190 is closed via closure 195 to completely enclose inner bag 200 therein. Hazardous remains system 185, with the contaminants or human remains enclosed therein, can then be lifted and/or carried by one or more bearers who manually grip and lift hazardous remains system 185 to transport the contaminants or human remains where desired. A mechanical device can also be used to lift hazardous remains system 185.

As used in this application, the word "about" for dimensions, weights, and other measures means a range that is ±10% of the stated value, more preferably ±5% of the stated value, and most preferably ±1% of the stated value, including all sub-ranges therebetween. Also as used herein, the terms "first" and "second" are for relative descriptive purposes only and do not connote that one comes before the other or that one has a superior position to the other.

It should be understood that the foregoing description is only illustrative of the present disclosure. Various alternatives and modifications can be devised by those skilled in the art without departing from the present disclosure. Accordingly, the present disclosure is intended to embrace all such alternatives, modifications, and variances that fall within the scope of the disclosure.

What is claimed is:

1. A hazardous material containment system for the handling and transporting of contaminants, comprising:

an outer bag;

an inner bag inside of and enclosed by the outer bag, wherein the inner bag encloses all or part of the contaminants and prevents the contaminants from escaping;

an inner closure connected to the inner bag for providing access to an interior of the inner bag;

an absorbent core made of an absorbent material, wherein the absorbent core is in the inner bag for absorbing liquids from the contaminants;

an active agent in the absorbent core for neutralizing or minimizing contamination of the contaminants, and wherein the inner bag further comprises an exterior shell that surrounds the absorbent core, wherein the exterior shell provides stability to the inner bag, and wherein the absorbent core has a greater circumference than the exterior shell to cover the inner closure and prevent gases from escaping through the inner closure.

2. The hazardous material containment system of claim 1, further comprising an outer closure connected to the outer bag for providing access to an interior of the outer bag, and wherein the inner bag is removable from the outer bag by opening the outer closure.

3. The hazardous material containment system of claim 1, wherein the outer bag comprises a nylon material with a polymer backing.

4. The hazardous material containment system of claim 1, wherein the inner bag further includes:

a first layer adjacent the absorbent core; and a chemical barrier adjacent the first layer to contain the contaminants in the inner bag, and wherein the exterior shell is adjacent the chemical barrier.

5. The hazardous material containment system of claim 4, wherein the first layer is a carbon cloth laminated to the absorbent core.

6. The hazardous material containment system of claim 4, wherein the exterior shell comprises a thermal polyurethane.

7. The hazardous material containment system of claim 1, wherein the active agent is an antimicrobial, a quaternary ammonium compound, active carbon, nanoparticles, and combinations thereof.

8. The hazardous material containment system of claim 1, wherein the inner closure is waterproof.

* * * * *